US009040800B2

(12) United States Patent
Shirakawa

(10) Patent No.: US 9,040,800 B2
(45) Date of Patent: May 26, 2015

(54) MUSICAL TONE SIGNAL GENERATING APPARATUS

(75) Inventor: Tokio Shirakawa, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 52 days.

(21) Appl. No.: 13/355,405

(22) Filed: Jan. 20, 2012

(65) Prior Publication Data

US 2012/0186417 A1 Jul. 26, 2012

(30) Foreign Application Priority Data

Jan. 20, 2011 (JP) ..... 2011-9605

(51) Int. Cl.
*G10H 7/00* (2006.01)
*G10H 7/02* (2006.01)

(52) U.S. Cl.
CPC ..... *G10H 7/02* (2013.01); *G10H 2250/621* (2013.01)

(58) Field of Classification Search
None
See application file for complete search history.

(56) References Cited

U.S. PATENT DOCUMENTS 5,086,475 A * 2/1992 Kutaragi et al. ..... 704/265
5,146,834 A * 9/1992 Izumisawa et al. ..... 84/607
5,252,773 A * 10/1993 Kozuki et al. ..... 84/607
5,288,940 A * 2/1994 Izumisawa ..... 84/603
5,637,821 A * 6/1997 Izumisawa et al. ..... 84/604
8,389,845 B2 * 3/2013 Kunimoto et al. ..... 84/605
2004/0069118 A1 4/2004 Okazaki et al.
2011/0094368 A1 * 4/2011 Kunimoto et al. ..... 84/605
2012/0031256 A1 * 2/2012 Tsuchiya et al. ..... 84/604
2012/0186417 A1 * 7/2012 Shirakawa ..... 84/603
2013/0174714 A1 * 7/2013 Adachi ..... 84/603

FOREIGN PATENT DOCUMENTS

JP 9-146555 A 6/1997
JP 09-230860 A 9/1997
JP 2004-212735 A 7/2004
JP 2004-294780 A 10/2004

OTHER PUBLICATIONS

Japanese Office Action dated Nov. 18, 2014, for JP Application No. 2011-009605, with English Translation, five pages.

* cited by examiner

*Primary Examiner* — Marlon Fletcher
(74) *Attorney, Agent, or Firm* — Morrison & Foerster LLP

(57) ABSTRACT

A musical tone signal generating apparatus has waveform memory WM which stores a plurality of compressed data sets obtained by compressing, by linear prediction, sample values obtained by sampling musical tones. The musical tone signal generating apparatus has cache circuit 740 which reads out compressed data from waveform memory WM within an assigned computing period in response to instructions to generate a musical tone, and decoding circuit 750 which decodes the compressed data and outputs the decoded data as the data indicative of a sample value. The musical tone signal generating apparatus has CPU 901 inputs tone pitch information indicative of a tone pitch of a musical tone which is to be generated, identifies waveform data which is to be read out by cache circuit 740 from waveform memory WM and determines, in accordance with the identified waveform data, the length of the computing period which is to be assigned.

7 Claims, 15 Drawing Sheets

MUSICAL TONE SIGNAL GENERATING APPARATUS

BACKGROUND OF THE INVENTION

1. Field of the Invention

The present invention relates to a musical tone signal generating apparatus which reads out waveform data from a waveform memory storing waveform data indicative of waveforms of musical tones and generates musical tone signals.

2. Description of the Related Art

As described in Japanese Unexamined Patent Publication No. 9-146555, for example, there is a conventional musical tone signal generating apparatus having a plurality of tone generation channels for generating musical tone signals. The conventional musical tone signal generating apparatus has a waveform memory in which sample values obtained at respective sampling periods by sampling respective musical tones for respective certain tone ranges are compressed to be stored in continuous addresses in the order of sampling period. Because the musical tone signal generating apparatus adopts a compression method of compressing each sample value in relation to the difference between the sample value and the immediately preceding sample value, the musical tone signal generating apparatus is necessary to use the immediately preceding sample value in order to decode compressed data. At each reading of compressed data from the waveform memory, therefore, the musical tone signal generating apparatus increments a reading address by 1.

In the conventional musical tone signal generating apparatus, furthermore, respective periods obtained by time-dividing one period (hereafter referred to as a reproduction period) in which a musical tone signal is generated by respective tone generation channels are assigned as processing periods to the respective tone generation channels. In response to instructions to generate a musical tone signal, more specifically, the respective tone generation channels read compressed data from the waveform memory in their respective assigned processing periods and decode the read compressed data to generate the musical tone signal. In a case where the tone pitch of a sampled musical tone (hereafter referred to as the original pitch) is different from the tone pitch of a musical tone signal which is to be generated (hereafter referred to as the reproduction pitch), sets of compressed data stored in continuous addresses are read out to decode the read compressed data to figure out a plurality of sample values. By performing interpolation by use of the plurality of sample values, the conventional musical tone signal generating apparatus figures out a sample value corresponding to the tone pitch of the musical tone signal which is to be generated.

SUMMARY OF THE INVENTION

For reading out a set of compressed data from the waveform memory, however, a certain period of time is required. Therefore, the number of compressed data sets which a tone generation channel is able to read out in a processing period assigned to the tone generation channel is small, while the number of compressed data sets which can be decoded in the tone generation channel within the processing period is also small. Particularly, in a case where the musical tone signal generating apparatus has a number of tone generation channels, a processing period assigned to a tone generation channel is quite short, resulting in a few compressed data sets which can be decoded in the processing period. For instance, the number of compressed data sets which can be decoded in an assigned processing period is only two. Because the conventional musical tone signal generating apparatus always increments the reading address by 1, the number of addresses which can be processed in an assigned processing period is up to two, resulting in the ratio of the reproduction pitch (hereafter referred to as the pitch magnification) to the original pitch being limited to twice. As a result, the conventional musical tone signal generating apparatus is required to sample musical tones at least at each octave, so that the musical tone signal generating apparatus has to have a waveform memory of a large capacity.

The present invention was accomplished to solve the above-described problem, and an object thereof is to provide a musical tone signal generating apparatus which decodes a set of compressed data obtained by compressing a sample value in relation to the difference from the immediately preceding sample value to figure out the next sample value, the musical tone signal generating apparatus allowing to increase pitch magnification while reducing the storage capacity of a waveform memory. In the following description of respective constituent features of the present invention, in order to facilitate understanding of the invention, numbers and letters are given in parentheses to corresponding constituents of a later-described embodiment. However, the constituent features of the invention are not limited to the constituents indicated by the numbers and letters in the embodiment.

In order to achieve the above-described object, it is a feature of the present invention to provide a musical tone signal generating apparatus including a waveform memory (WM) in which waveform data formed of a plurality of compressed data sets obtained by sampling a plurality of musical tones having different tone pitches and compressing sample values in relation to differences between the sample values and their respective immediately preceding sample values is stored for the respective tone pitches; computing means (740, 750) for reading compressed data from the waveform memory within an assigned computing period in response to instructions to generate a musical tone, decoding the compressed data, and outputting data indicative of a sample value of the decoded compressed data; computing period determining means (S12, S14, S16) for inputting tone pitch information indicative of a tone pitch of the musical tone which is to be generated, identifying waveform data which is among the plurality of waveform data stored in the waveform memory and is to be read by the computing means, and determining the length of the assigned computing period in accordance with the identified waveform data; and interpolating means (760) for interpolating the data indicative of the sample value output by the computing means in accordance with a ratio of the tone pitch of the musical tone which is to be generated to an original tone pitch of a musical tone represented by the waveform data identified by the computing period determining means, and outputting the interpolated result. In this case, the compressed data may be calculated in accordance with a difference between a sample value and a sample value predicted by use of linear prediction.

In this case, furthermore, the musical tone signal generating apparatus may further include decoding number calculating means (730) for calculating, in accordance with the ratio of the tone pitch of the musical tone which is to be generated to the original tone pitch of the musical tone represented by the waveform data identified by the computing period determining means, the number of compressed data sets which are to be decoded in the computing period.

In this case, furthermore, the computing means may include cache means (740) for performing cache processing for reading the compressed data from the waveform memory and temporarily storing the read compressed data; and decoding means (750) for performing decoding processing for decoding the compressed data stored in the cache means and calculating a sample value; and the computing period may be formed of a cache processing period in which the cache means performs the caching processing; and a decoding period in which the decoding means performs the decoding processing.

In this case, furthermore, each of the cache processing period and the decoding processing period may be formed of one or more of time-division time slots obtained by time-dividing a certain period of time; and the computing period determining means may determine, in accordance with the identified waveform data, the respective numbers of time-division time slots assigned as the cache processing period and the decoding processing period, respectively.

According to the musical tone signal generating apparatus configured as described above, the length of a period assigned to the processing for calculating a sample value can vary in accordance with waveform data. In a case where the waveform data having a possibility of requiring increased pitch magnification has been selected, more specifically, the period assigned to the processing for calculating a sample value can be prolonged, compared with a case where the waveform data which does not require increased pitch magnification. According to the musical tone signal generating apparatus, therefore, the computing means is allowed to move the reading address forward by a value corresponding to the pitch magnification to read out compressed data to decode the read compressed data to calculate a sample value in the assigned period of a reproduction period. By use of the sample value calculated by the computing means, furthermore, the interpolating means calculates a sample value corresponding to the pitch magnification. Therefore, the pitch magnification can be increased. More specifically, the pitch magnification can be increased by two times or more. As for the sampling of musical tones, as a result, musical tones can be sampled at the intervals of one octave or more (e.g., every two octaves), which reduces the storage capacity of the waveform memory. Furthermore, because the length of the assigned period is determined according to the selected waveform data, the number of musical tone signals that can be generated concurrently will not be decreased significantly.

It is the other feature of the present invention that the waveform memory is a memory which is separated into pages each having a certain address range, and is configured such that when reading of a first data stored in an address is continuously followed by reading of a second data from a page in which the first data is also stored, the second data can be read faster than the first data; and the cache processing period is longer than a period of time necessary to read at least two sets of data from a page. In this case, the first data and the second data may include the compressed data sets, respectively.

According to the musical tone signal generating apparatus configured as described above, the musical tone signal generating apparatus is able to access to the same page of the waveform memory repeatedly in a cache processing period. In this case, because the second and later sets of data can be read out fast, the computing means is able to efficiently read voluminous compressed data within the cache processing period. More specifically, the computing means is able to previously read compressed data corresponding to the number of decoding for a plurality of reproduction periods within a cache processing period. In a case, particularly, where data is configured such that data stored in an address includes a plurality of compressed data sets, the plurality of compressed data can be read only by one access, resulting in more efficient reading of compressed data.

DESCRIPTION OF THE PREFERRED EMBODIMENT a. General Configuration

Figure 1:
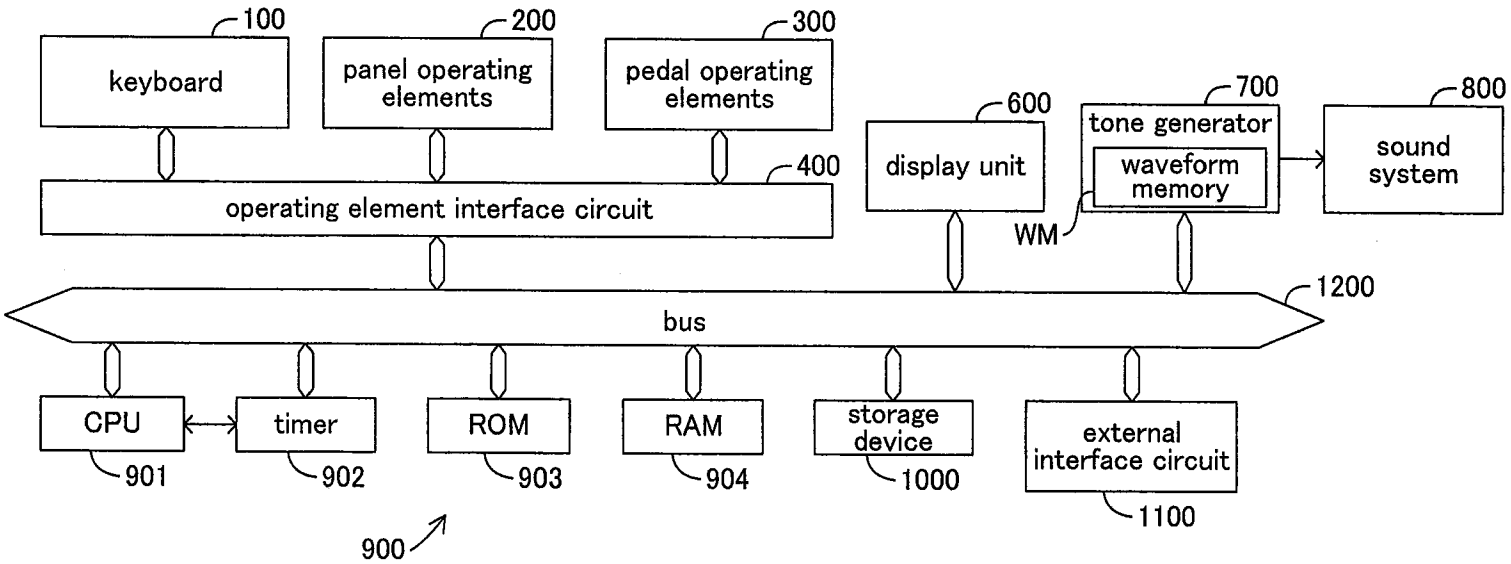
FIG. 1 is a block diagram of an entire electronic musical instrument to which a musical tone signal generating apparatus according to an embodiment of the present invention is applied.

The general configuration of an electronic musical instrument to which a musical tone signal generating apparatus according to an embodiment of the present invention is applied will be described with reference to FIG. 1. As indicated in FIG. 1, this electronic musical instrument has a keyboard 100, a panel operating elements 200, pedal operating elements 300, an operating element interface circuit 400, a display unit 600, a tone generator 700, a sound system 800, a computer portion 900, a storage device 1000 and an external interface circuit 1100.

The keyboard 100 is formed of a plurality of white keys and a plurality of black keys which are manipulated by player's hands to specify respective tone pitches of musical tone signals that are to be generated and to instruct to generate or stop the musical tone signals. The panel operating elements 200 arranged on an operating panel of the electronic musical instrument are manipulated by the player's hands to specify various kinds of characteristics of musical tones such as tone color, tone volume and effects of musical tone signal which are to be generated. The panel operating elements 200 are also used in order to specify the entire operation of the electronic musical instrument. The pedal operating elements 300 are manipulated by a player's foot in order to specify characteristics of musical tone signals such as tone color, tone volume and effects.

The keyboard 100, the panel operating elements 200 and the pedal operating elements 300 are connected to the operating element interface circuit 400 connected to a bus 1200. Musical performance information and operational information indicative of manipulation of the keyboard 100, the panel operating elements 200 or the pedal operating elements 300 are supplied to the later-described computer portion 900 through the operating element interface circuit 400 and the bus 1200. The display unit 600, which is configured by a liquid crystal display (LCD), displays letters, graphics and the like on a screen. The display on the display unit 600 is controlled by the computer portion 900 via the bus 1200.

The tone generator 700, which includes a waveform memory WM in which a plurality of sets of waveform data are stored, has a plurality of tone generation channels which read out waveform data specified by the computer portion 900 from the waveform memory WM to generate digital musical tone signals. The digital musical tone signals generated by the respective tone generation channels are supplied to the sound system 800. The tone generator 700 also includes an effect circuit which adds various kinds of effects such as chorus and reverb to digital musical tone signals. The sound system 800 includes a D/A convertor for converting digital musical tone signals supplied from the tone generator 700 into analog musical tone signals, amplifiers for amplifying the converted analog musical tone signals, and speakers for converting the amplified analog musical tone signals into acoustic signals and outputting the acoustical signals.

The computer portion 900 is formed of a CPU 901, a timer 902, a ROM 903 and a RAM 904 which are connected to the bus 1200, respectively. The CPU 901 supplies information necessary for generation of musical tones to the tone generator 700 in accordance with musical performance information supplied from the operating element interface circuit 400 and the external interface circuit 1100. To one or more of the tone generation channels, particularly, the CPU 901 assigns generation of a musical tone corresponding to a note-on event generated by a player's depression of a key on the keyboard 100 or by musical performance information supplied from an external apparatus via the external interface circuit 1100.

The storage device 1000, which includes voluminous non-volatile storage media such as HDD, FDD, CD-ROM, MO and DVD and drive units for the storage media, enables the electronic musical instrument to store and read out various kinds of data and programs. These data and programs may be previously stored in the storage device 1000. Alternatively, these data and programs may be externally retrieved through the external interface circuit 1100. The various kinds of data and programs stored in the storage device 1000 are read by the CPU 901 to be used for control of the electronic musical instrument. The external interface circuit 1100, which includes a MIDI interface circuit and a communication interface circuit, allows the electronic musical instrument to connect to a MIDI-capable external apparatus such as a different electronic musical apparatus and a personal computer, also allowing the electronic musical instrument to connect to a communication network such as the Internet.

b. Configuration of the Tone Generator b1. General Configuration

Figure 2:
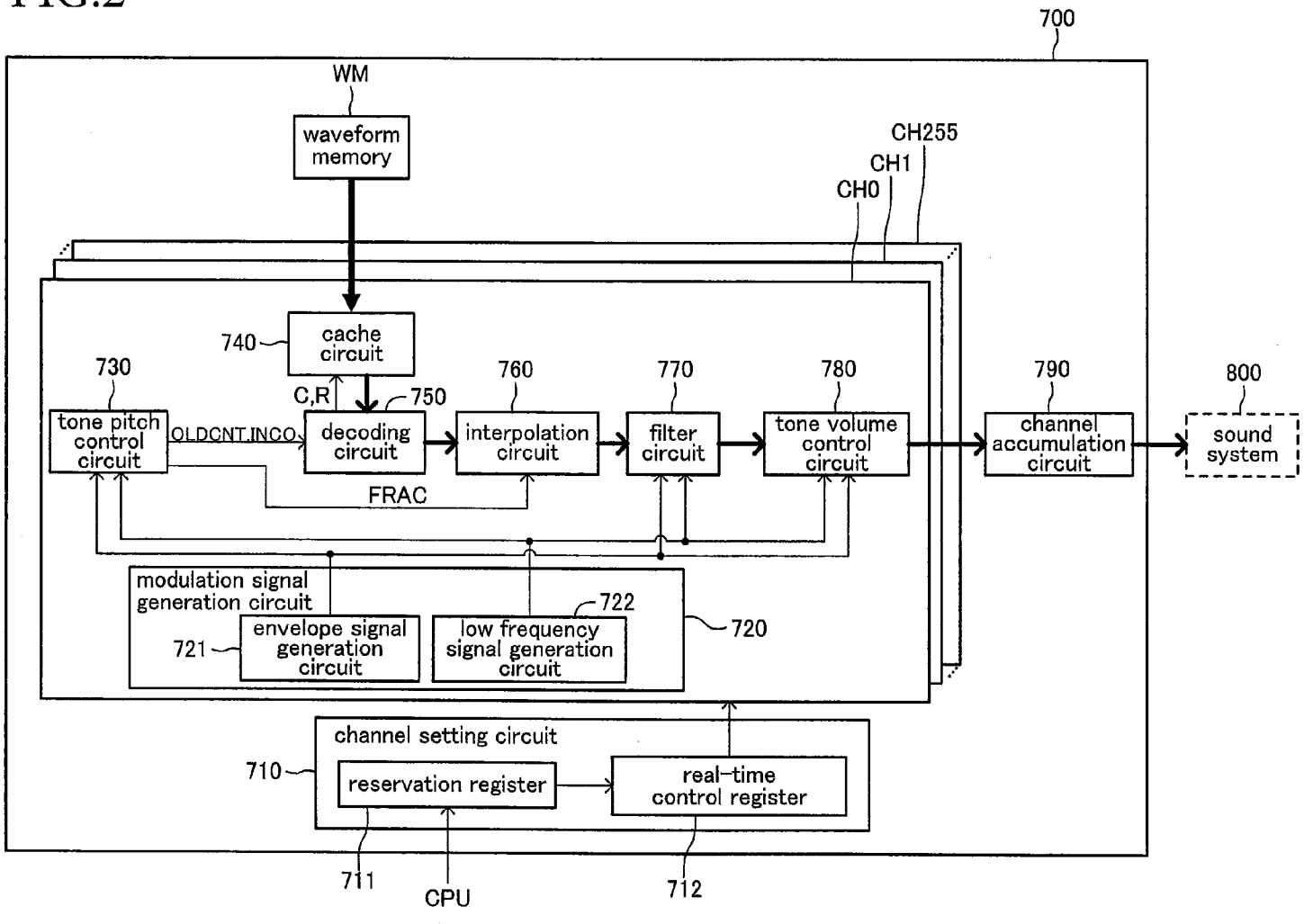
FIG. 2 is a block diagram indicative of a concrete configuration of a tone generator indicated in FIG. 1.

Next, the detailed configuration of the tone generator 700 will be described. Referring to FIG. 2, the general configuration of the tone generator 700 will be explained. The tone generator 700 has a channel setting circuit 710 which inputs parameters supplied from the CPU 901 and outputs the input parameters to circuits which configure the tone generator 700 to make various settings of the respective tone generation channels. The tone generator 700 also has the waveform memory WM which stores compressed data obtained by sampling musical tones and compressing sample values at sampling periods. In addition, the tone generator 700 has a plurality of tone generation channels (256 channels, for example) CHO, CH1, . . . , CH255 which successively read compressed data from the waveform memory WM and decode the read data to figure out original sample values to generate digital musical tone signals in time division. Each of the tone generation channels CHO, CH1, . . . , CH255 has a modulation signal generation circuit 720, a tone pitch control circuit 730, a cache circuit 740, a decoding circuit 750, an interpolation circuit 760, a filter circuit 770 and a tone volume control circuit 780. Actually, however, these circuits are not provided for each of the tone generation channels CHO, CH1, . . . , CH255, but carry out processing for the respective tone generation channels CHO, CH1, . . . , CH255 in time division. The tone generator 700 also has a channel accumulation circuit 790 which accumulates digital musical tone signals generated by the tone generation channels CHO, CH1, . . . , CH255 and outputs the accumulated digital musical tone signals to the sound system 800.

Figure 3:
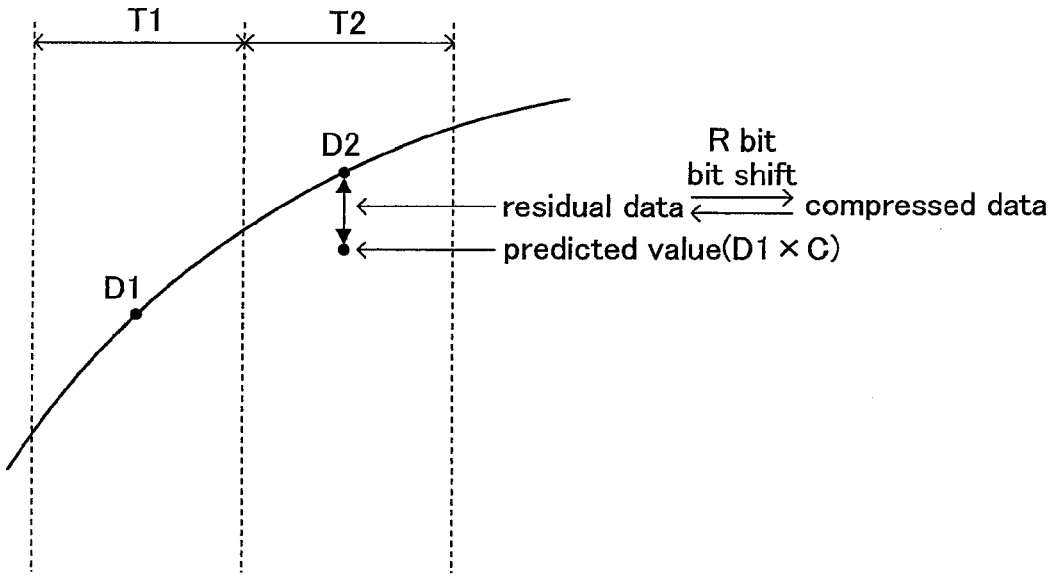
FIG. 3 is a diagram explaining decoding of compressed data.

Decoding of compressed data by the respective tone generation channels will be explained briefly. In the waveform memory WM, compressed data in which sample values are compressed at respective sampling periods by linear prediction is stored. A set of compressed data is bit-shifted data obtained by discarding some bits of the LSB side of residual data which is the difference between a sample value and a predicted value figured out by linear prediction. In this embodiment, a predicted value is obtained by multiplying a sample value obtained at the immediately preceding reproduction period by a linear prediction coefficient C. Referring to FIG. 3, the calculation of a sample value D2 of a reproduction period T2 will be explained concretely. Firstly, a predicted value is figured out by multiplying a sample value D1 obtained at the immediately preceding reproduction period T1 by the linear prediction coefficient C. Furthermore, residual data representative of the difference between the predicted value and the sample value D2 is figured out by bit-shifting the compressed data by a denormalization coefficient R. Then, the predicted value is added to the residual data to obtain the sample value D2. The above-described linear prediction coefficient C and the denormalization coefficient R will be described later.

b2. Channel Setting Circuit

The channel setting circuit 710 has a reservation register 711 and a real-time control register 712 for storing various parameters for each of the tone generation channels. After determining a tone generation channel which is to generate a musical tone signal corresponding to a key-on event, the CPU 901 writes a parameter which specifies a musical tone that is to be generated in an area which corresponds to the determined tone generation channel and is situated in the reservation register 711. When the tone generation channel is ready to generate the musical tone specified by the parameter, the channel setting circuit 710 copies the parameter to the real-time control register 712, and outputs corresponding parameters to the respective circuits of the tone generation channel to initialize the tone generation channel. The CPU 901 then instructs the tone generation channel to start generating the musical tone signal. During the generation of the musical tone signal at the determined tone generation channel, the CPU 901 is able to write parameters to the real-time control register 712. In accordance with player's manipulation of the panel operating elements 200, for example, parameters for varying the tone pitch of the musical tone which is currently being generated can be written into the real-time control register 712. The channel setting circuit 710 outputs the parameters updated by the CPU 901 during the generation of the musical tone signal to a corresponding tone generation channel.

b3. Waveform Memory

Figure 4:
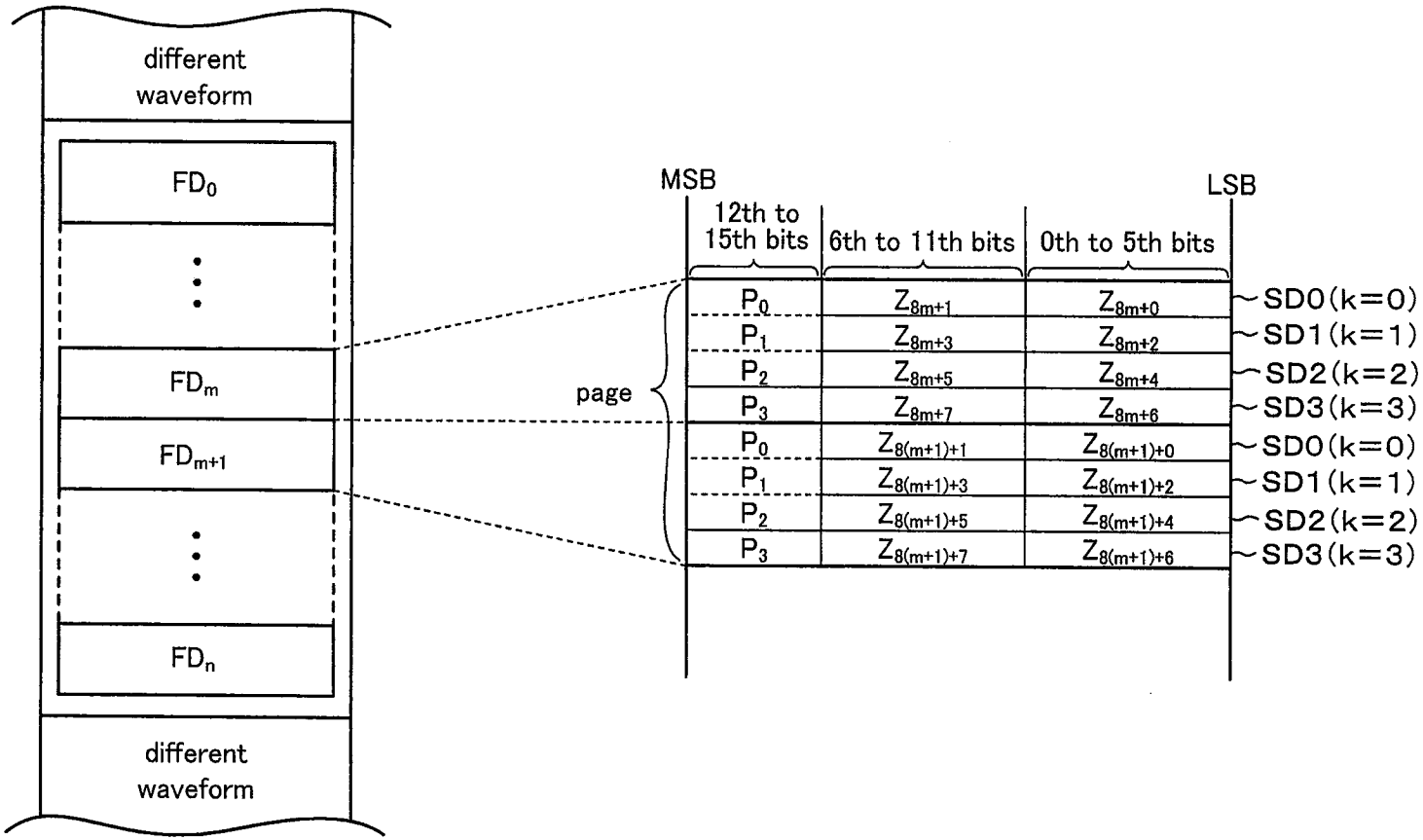
FIG. 4 is a memory map indicative of compressed data.

In the waveform memory WM, as indicated in FIG. 4, compressed data obtained by compressing waveform data indicative of waveforms of musical tones by linear prediction is stored. The waveform data (hereafter referred to as original waveform data) indicative of waveforms of musical tones is the data obtained by sampling musical tones at a certain sampling frequency (e.g., 32 kHz) to convert sample values of respective sampling periods into digital data.

As for sampling of musical tones of a tone color, musical tones are sampled at certain key tone pitch intervals (e.g., one octave or two octaves). More specifically, original waveform data is not provided for every key tone pitch. Therefore, in a case where the tone pitch (the reproduced pitch) represented by tone pitch information included in musical performance information is different from the tone pitch (the original pitch) of the original waveform data, the respective tone generation channels CH0, CH1, . . . , CH255 perform interpolation to generate a digital musical tone signal corresponding to the tone pitch represented by the tone pitch information. In this embodiment, in a case where a reproduced pitch is always twice or less than twice the original pitch because of the sampling of the original waveform data in one octave or smaller intervals, for example, one tone generation channel is used at each reproduction period to generate a digital musical tone signal. Such an operating mode is referred to as the first mode. In a case where a reproduced pitch can be more than twice the original pitch because of the sampling of original waveform data in two-octave intervals, for example, two tone generation channels are used at each reproduction period to generate a digital musical tone signal. Such an operating mode is referred to as the second mode. Whether the electronic musical instrument is to generate musical tones in the first mode or in the second mode is previously determined according to original waveform data to be stored as voice data (see FIG. 10).

The original waveform data is divided into a plurality of frames (in the case of FIG. 4, n+1 frames) each of which representing sample values of a plurality of sampling periods (in the case of FIG. 4, eight sampling periods). The respective frames are compressed by linear prediction so that the compressed frames will be stored as frame data sets $FD_0$ to $FD_n$ in the waveform memory WM in this order from the low-order address side to the high-order address side. The frame data set $FD_m$ (m=0, 1, . . . n) is configured by a plurality (e.g., four segments) of segment data $SD_0$ to $SD_3$. The data length of each segment data is 16 bits (1 word). A set of segment data is stored in an address of the waveform memory WM. The segment data sets $SD_0$ to $SD_3$ are stored in the waveform memory WM in this order from the low-order address side to the high-order address side. The segment data set $SD_k$ (k=0, 1, . . . , 3) of the frame data $FD_m$ is formed of two sets of compressed data $Z_{8m+2k}$, $Z_{8m+2k+1}$ and a parameter $P_k$. The data length of each compressed data $Z_{8m+2k}$, $Z_{8m+2k+1}$ is 6 bits, while the data length of the parameter $P_k$ is 4 bits. More specifically, data formed of the zeroth to fifth bits of the segment data is the compressed data $Z_{8m+2k}$, while data formed of the sixth to eleventh bits of the segment data is the compressed data $Z_{8m+2k+1}$. Data formed of the twelfth to fifteenth bits of the segment data is the parameter $P_k$. "8m+2k" and "8m+2k+1" represent numbers of the compressed data, respectively. The numbers correspond to the sampling periods of the original sample values (i.e., the order in which the original sample values have been sampled).

The 16-bit (=4 bits×4) data formed of parameters $P_0$ to $P_3$ is configured by the linear prediction coefficient C and the denormalization coefficient R for decoding sample values. The data length of the linear prediction coefficient C is 12 bits. The parameter $P_0$ corresponds to the eighth to eleventh bits of the linear prediction coefficient C, while the parameter $P_1$ corresponds to the fourth to seventh bits of the linear prediction coefficient C. The parameter $P_2$ corresponds to the zeroth to third bits of the linear prediction coefficient C. The linear prediction coefficient C is used for decoding a sample value belonging to the next frame.

The data length of the denormalization coefficient R is 4 bits, which correspond to the parameter P3. As described below, the denormalization coefficient R is the parameter for figuring out the original residual data on the basis of normalized compressed data. The compressed data is the data obtained by normalizing residual data representative of the difference between a predicted value figured out by linear prediction and a sample value represented by the original waveform data. Hereafter, the normalization of residual data will be described in detail. In the detailed description, the data length of the residual data is 16 bits. In a case where the value of the residual data is small enough to be represented by 6-bits, the value of the residual data can be stored directly in a set of segment data. In some cases, however, the value of residual data is too large to be represented by 6 bits. Therefore, one of the frames is selected to obtain the greatest residual data included in the residual data belonging to the selected frame. Assume that when the greatest residual data is represented in binary notation, the highmost bit of the bits having a value of "1", respectively, is the x-th bit (x=6, 7, . . . , 15). In this case, 6 bits from the (x−5)th bit to x-th bit of each residual data belonging to the frame to which the greatest residual data belongs are compressed data. For every residual data belonging to the frame data to which the greatest residual data belongs, more specifically, the bit shift operation is to be carried out to discard the zeroth to (x−6)-th bits. Therefore, the number of bits which have been shifted by the bit shift operation is stored as the denormalization coefficient R so that the compressed data can be decoded to shift up the compressed data by the value represented by the denormalization coefficient R to figure out the residual data.

Next, the speed at which data is read out from the waveform memory WM will be described. The storage space of the waveform memory WM is divided into a plurality of storage areas each storing continuous 8 words. Each divided storage area for continuous 8 words is referred to as a page. In a case where the reading of a set of data from a page is followed by continuous reading of the following sets of data from the same page, the following sets of data can be read out faster than the first set of data. Such continuous reading of a plurality of data sets from the same page is referred to as page reading.

Figure 5:
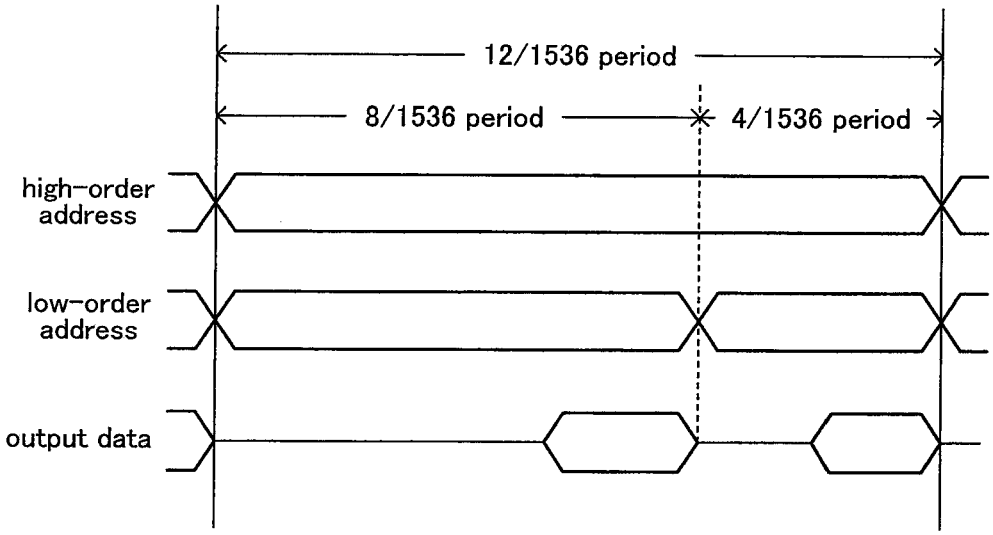
FIG. 5 is a time chart indicative of access timing of a waveform memory.

The above-described page reading will be described concretely, with reference to FIG. 5. First, the address of the first data is designated to read out the first data. The reading of the first data takes the time equivalent to $^{8}/_{1536}$ of a sampling period. With the third and later bits of the address of the first data being fixed, the zeroth to second bits are changed to read out the second data. The reading of the second data takes only $^{4}/_{1536}$ of a sampling period. In this embodiment, the segment data $SD_0$ of the top frame data $FD_0$ is arranged to be placed on the top of the page. As described in detail later, a segment data input circuit 741 of the cache circuit 740 reads out two sets of segment data at a time from the top segment data set. Therefore, the segment data input circuit 741 is able to read out the second data by page reading at high speed.

b4. Modulation Signal Generation Circuit

The modulation signal generation circuit 720 is configured by an envelope signal generation circuit 721 and a low frequency signal generation circuit 722. The envelope signal generation circuit 721 is configured by a pitch change circuit, a cut-off frequency change circuit and a tone volume change circuit. To the envelope signal generation circuit 721, various envelope parameters are supplied from the channel setting circuit 710. The pitch change circuit supplies tone pitch control signals for controlling the tone pitch of a digital musical tone signal which is to be generated to the tone pitch control circuit 730. In accordance with the envelope parameters supplied from the channel setting circuit 710, more specifically, the pitch change circuit generates the tone pitch control signals which vary with the passage of time so that the tone pitch of the digital musical tone signal will vary with the passage of time after the start of generation of a musical tone corresponding to the digital musical tone signal. The pitch change circuit then supplies the generated tone pitch control signals to the tone pitch control circuit 730. The series of tone pitch control signals which vary with the passage of time are referred to as pitch envelope.

The cut-off frequency change circuit supplies cut-off frequency control signals for controlling frequency response of element signals to the filter circuit 770. In accordance with the envelope parameters supplied from the channel setting circuit 710, more specifically, the cut-off frequency change circuit generates cut-off frequency control signals which vary with the passage of time so that the cut-off frequency of a filter will vary with the passage of time after the start of generation of the musical tone. The cut-off frequency change circuit then supplies the generated cut-off frequency control signals to the filter circuit 770. The series of cut-off frequency control signals which vary with the passage of time are referred to as cut-off envelope.

The tone volume change circuit supplies tone volume control signals for controlling the tone volume of element signals to the tone volume control circuit 780. In accordance with the envelope parameters supplied from the channel setting circuit 710, more specifically, the tone volume change circuit generates the tone volume control signals which vary with the passage of time so that the tone volume of the digital musical tone signal varies with the passage of time after the start of generation of the musical tone. The tone volume change circuit then supplies the generated tone volume control signals to the tone volume control circuit 780. The series of tone volume control signals which vary with the passage of time are referred to as tone volume envelope.

The low frequency signal generation circuit 722 generates modulation signals which periodically vary the tone pitch, the tone color and the tone volume after the start of generation of a musical tone, and then supplies the generated modulation signals to the tone pitch control circuit 730, the filter circuit 770 and the tone volume control circuit 780, respectively. To the low frequency signal generation circuit 722, low frequency signal control parameters are supplied from the channel setting circuit 710. The low frequency signal control parameters include data which specifies the waveform, the frequency and the amplitude of modulation signals which are to be output from the low frequency signal generation circuit 722.

b5. Tone Pitch Control Circuit

The tone pitch control circuit 730 calculates a pitch magnification by use of pitch information supplied from the channel setting circuit 710, the tone pitch control signals supplied from the envelope signal generation circuit 721 and the modulation signals supplied from the low frequency signal generation circuit 722. The pitch information is formed of an original pitch and tone pitch information included in performance information. In accordance with the calculated pitch magnification, the tone pitch control circuit 730 then calculates a decoding number INCO indicative of the number of sample values which are to be decoded in the next sampling period. More specifically, at each sampling period which is the fourth sampling period or later, the pitch magnification is accumulated so that the value of the difference between the integer of the previous accumulated result and the integer of the current accumulated result will be defined as the decoding number INCO of the next sampling period. The thus calculated decoding number INCO is then supplied to the decoding circuit 750.

In the second mode, however, if the calculated decoding number is "3" or more, the decoding number is distributed so that the total number of decoding numbers supplied to the two tone generation channels (hereafter referred to as the tone generation channel CHa and the tone generation channel CHb) set as the tone generation channels for the second mode will be the calculated decoding number. In a case where the calculated decoding number INCO is "3", for example, the tone generation channel CHa is given "2" as the decoding number INCO, while the tone generation channel CHb is given "1" as the decoding number INCO. In a case where the calculated decoding number INCO is "4", the tone generation channel CHa and the tone generation channel CHb are given "2", respectively. The respective decoding numbers INCO for the first to fourth periods of the reproduction periods are fixed regardless of the operating mode and the pitch magnification. More specifically, the decoding numbers INCO for the first and second periods are "0". The decoding number INCO for the third period is "2", while the decoding number INCO for the fourth period is "1".

The pitch magnification usually has a decimal fraction. The tone pitch control circuit 730 supplies the decimal fraction of the accumulated value of the calculated pitch magnification as interpolation coefficient calculation data FRAC to the interpolation circuit 760. For each tone generation channel, furthermore, the tone pitch control circuit 730 stores processed data information OLDCNT indicative of compressed data which has been used most recently in order to calculate a sample value in the immediately preceding reproduction period. The processed data information OLDCNT is formed of a frame data number indicative of a number of frame data to which the compressed data belongs, a segment data number indicative of a number of segment data and an index number indicative of the compressed data set included in a plurality of compressed data sets belonging to the segment data. In a case where the compressed data set belongs to the segment data $SD_k$ of the frame data $FD_m$, more specifically, the tone pitch control circuit 730 stores "m" as the frame data number, and "k" as the segment data number, respectively. The index number indicates the ordinal position of the compressed data set, counting from the LSB side of the segment data. In a case where the compressed data set is the first data, when counting from the LSB side of the segment data, the tone pitch control circuit 730 stores "0" as the index number. In a case where the compressed data set is the second data, when counting from the LSB side of the segment data, the tone pitch control circuit 730 stores "1" as the index number. At each start of generation of a musical tone in each tone generation channel, the frame data number is reset to "n", while the segment number is reset to "3". In addition, the index number is reset to "1".

The tone pitch control circuit 730 which has calculated the decoding number INCO stores the calculated decoding number INCO and the processed data information OLDCNT to supply the stored decoding number INCO and data information OLDCNT to the decoding circuit 750 at the start of decoding at respective tone generation channels of the next reproduction period. After supplying the decoding number INCO and data information OLDCNT to the decoding circuit 750, the tone pitch control circuit 730 increments the index number of the processed data information OLDCNT by the number indicated by the decoding number INCO. Format data BPS indicative of the number of compressed data sets included in a set of segment data is also supplied from the channel setting circuit 710 to the tone pitch control circuit 730. In this embodiment, the value of the format data BPS is "2". At the time of above-described processing for incrementing the index number, each time when the index number has the same value as that of the supplied format data BPS, the tone pitch control circuit 730 increments the segment number by "1", and sets the index number to "0". At each time when the segment number becomes "4", the tone pitch control circuit 730 increments the frame number by "1", and sets the segment number at "0". In the second mode, however, the processed data information OLDCNT for the tone generation channel CHa is used for both the processing for the tone generation channel CHa and the processing for the tone generation channel CHb.

b6. Cache Circuit

Figure 6:
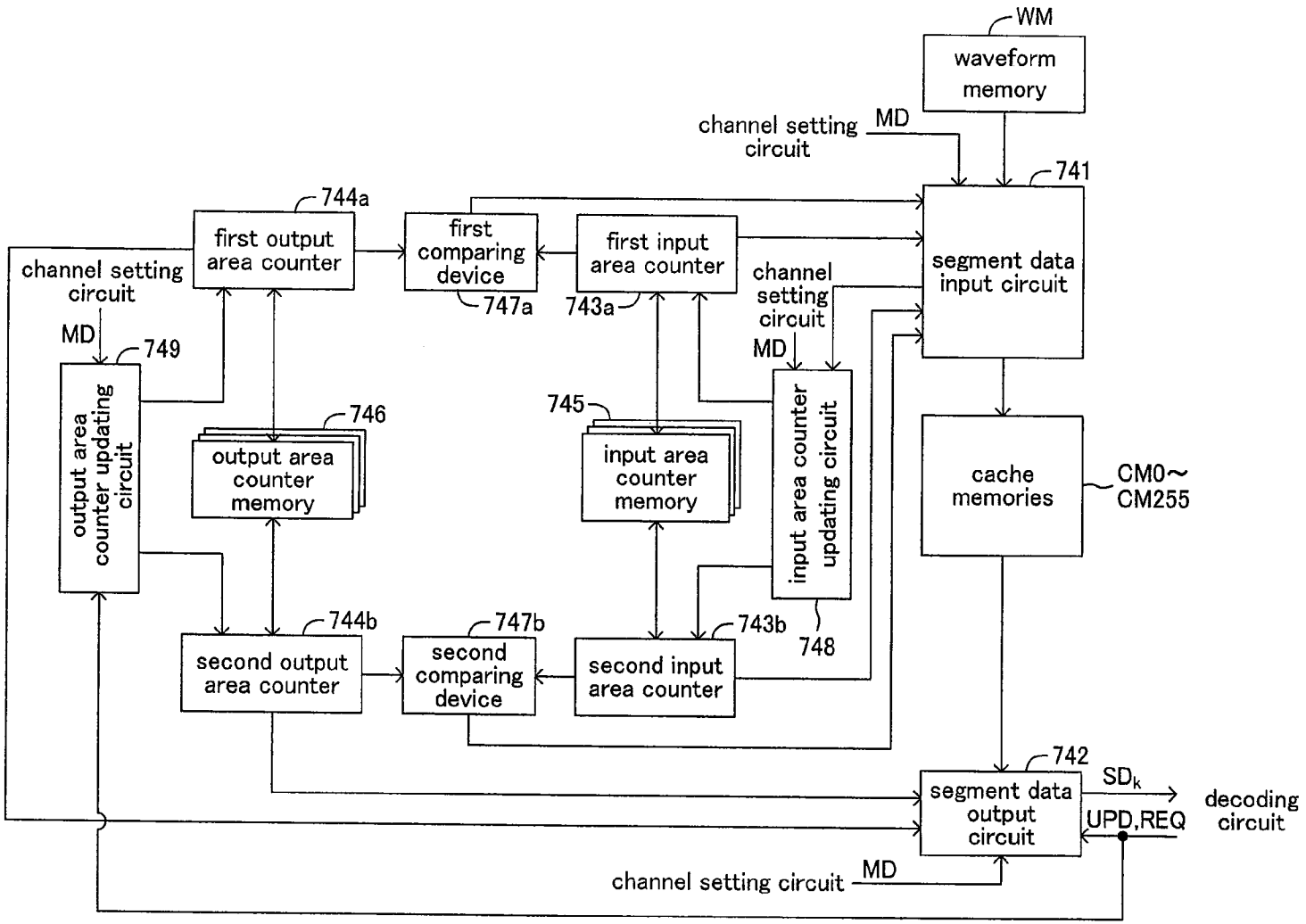
FIG. 6 is a block diagram indicative of a concrete configuration of a cache memory indicated in FIG. 2.

As indicated in FIG. 6, the cache circuit 740 has the segment data input circuit 741 for reading segment data into cache memories CM0 to CM255 from the waveform memory WM and a segment data output circuit 742 for supplying the segment data read into the cache memories CM0 to CM255 to the decoding circuit 750.

Figure 7:
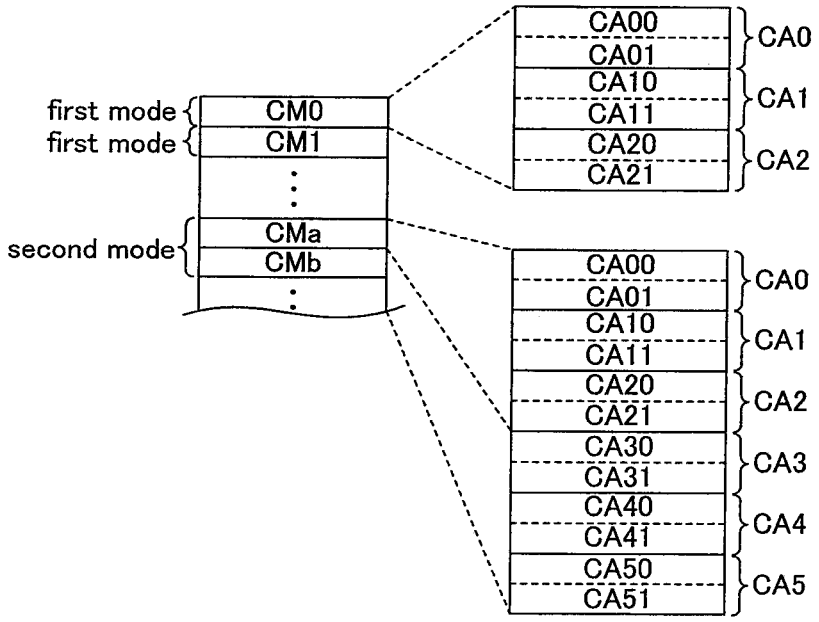
FIG. 7 is a memory map indicative of a configuration of a cache memory.

The cache memories CM0 to CM255, which are provided to correspond to the tone generation channels CH0 to CH255, respectively, are the memories for temporarily storing compressed data read by the segment data input circuit 741. Each of the cache memories CM0 to CM255 has a storage capacity of 6 words. As indicated in FIG. 7, furthermore, each of the cache memories CM0 to CM255 is divided into areas CA0 to CA2 each having a storage capacity of 2 words. The respective low-order address areas of the area CA0, area CA1 and area CA2 are referred to as area CA00, area CA10 and area CA20. The respective high-order address areas of the area CA0, area CA1 and area CA2 are referred to as area CA01, area CA11 and area CA21. In the second mode, however, a cache memory CMa and a cache memory CMb provided to correspond to the tone generation channel CHa and the tone generation channel CHb, respectively, are used integrally. More specifically, the storage areas for 12 words are divided into areas CA0 to CA5 each having a capacity of 2 words. In this case, similarly to the areas CA0 to CA2, the low-order address areas of the areas CA3 to CA5 are referred to as areas CA30, CA40 and CA50, respectively, while the high-order address areas are referred to as areas CA31, CA41 and CA51.

The segment data input circuit 741 reads segment data for the even-numbered tone generation channels CH0, CH2, . . . , CH254 at respective periods obtained by dividing one reproduction period into 128 equal periods into their corresponding cache memories CM0, CM2, CM254, respectively. The segment data input circuit 741 then reads segment data for the odd-numbered tone generation channels CH1, CH3, . . . , CH255 at respective periods obtained by dividing the next reproduction period into 128 equal periods into their corresponding cache memories CM1, CM3, . . . , CM255, respectively. If one reproduction period were divided into 256 equal periods which is the same number as the total number of tone generation channels, the respective periods are too short to read segment data (see FIG. 5). In this embodiment, therefore, one reproduction period is divided into 128 periods so that two segment data sets are read by page reading at one period.

To the segment data input circuit 741, the absolute address of the top segment data $SD_0$ of the frame data $FD_0$ and the absolute address of the last segment data $SD_3$ of the frame data $FD_n$ are supplied from the channel setting circuit 710. With the address of the segment data $SD_0$ of the frame data $FD_0$ being defined as "0" as the relative address, the segment data input circuit 741 stores relative addresses of segment data sets which are among those segment data sets stored in addresses continued from the segment data set $SD_0$ and are to be read next for the respective tone generation channels. The segment data input circuit 741 resets the relative address to "0" at the time of the start of tone-generation at each tone generation channel, and increments the relative address by two each time the segment data input circuit 741 reads two segment data sets. The segment data input circuit 741 then adds the relative address to the absolute address of the segment data $SD_0$ of the frame data $FID_0$ to figure out the reading address representative of the absolute address in which the segment data to read is stored. At the time of the start of tone-generation at the tone generation channel CHb in the second mode, however, the same address as that of the tone generation channel CHa is supplied as the absolute address of the segment data $SD_0$ of the frame data $FD_0$ of the waveform data which is to be read. In the processing for the tone generation channel CHb, the segment data input circuit 741 uses the relative address of the tone generation channel CHa to figure out a reading address. When the reading address becomes greater than the absolute address of the segment data $SD_3$ of the frame data FDn, the segment data input circuit 741 terminates the reading of segment data. By the terminated reading of segment data, the tone-generation processing for a note-on event completes.

In a case where the cache memory of a tone generation channel which is to generate a musical tone has free space, the segment data input circuit 741 reads segment data into the free space. Having free space is a case where the cache memory has space where any segment data has not been read, or a case where the cache memory has space where only the segment data whose compressed data has been already decoded is stored.

The cache circuit 740 has a first input area counter 743*a* which is a ternary counter circuit for the first mode, and is indicative of an area which is included in areas CA0 to CA2 and into which segment data is to be read next. The cache circuit 740 also has a second input area counter 743*b* which is a senary counter circuit for the second mode, and is indicative of an area which is included in areas CA0 to CA5 and into which segment data is to be read next. The cache circuit 740 also has a first output area counter 744*a* which is a ternary counter circuit for the first mode, and is indicative of an area which is included in areas CA0 to CA2 and in which segment data that is to be supplied to the decoding circuit 750 next is stored. The cache circuit 740 also has a second output area counter 744*b* which is a senary counter circuit for the second mode, and is indicative of an area which is included in areas CA0 to CA5 and in which segment data that is to be supplied to the decoding circuit 750 next is stored.

Respective values of the counters indicated at the end of the processing period of the respective tone generation channels in the immediately preceding reproduction period are stored in an input area counter memory 745 and an output area counter memory 746 for each of the tone generation channels. At the time of the start of the processing of the respective tone generation channels in the following reproduction period, furthermore, according to the operating mode, the counter values indicated at the end of the immediately preceding reproduction period are read from the input area counter memory 745 into the first input area counter 743*a* or the second input area counter 743*b*, while the counter values indicated at the end of the immediately preceding reproduction period are read from the output counter memory 746 into the first output area counter 744*a* or the second output area counter 744*b*.

The cache circuit 740 has a first comparing device 747*a* which compares counted values between the first input area counter 743*a* and the first output area counter 744*a* and supplies a signal indicative of whether the counted values match with each other or not to the segment data input circuit 741. In the first mode, as described hereafter, in a case where the counted value of the first input area counter 743*a* matches with the value of the first output area counter 744*a*, the match between the two counters indicates that there is no free space in the cache memory. In a case where the counted value of the first input area counter 743*a* does not match with the counter value of the first output area counter 744*a*, the mismatch between the two counters indicates that there is free space in the cache memory.

Because segment data read into the cache memory is to be output to the decoding circuit 750, the counted value of the first input area counter 743*a* precedes the counted value of the first output area counter 744*a*. As described in detail later, however, in a case where the pitch magnification is small (e.g., "1.0"), the counted value of the first input area counter 743*a* proceeds faster than that of the first output area counter 744*a*. Because the first input area counter 743*a* and the first output area counter 744*a* are ternary counter circuits, the counted values vary at each increment such as "0", "1", "2", "0", "1", "2", . . . . That is, the same values are repeatedly indicated at every three increments. Therefore, in a case where the counted value of the first input area counter 743*a* is ahead of the counted value of the first output area counter 744*a* by three counts, the counted values match between them. In this case, because an area indicated by the counted value can contain compressed data which has not been decoded yet, it is considered that the cache memory has no free space. In a case where the counted values do not match with each other, on the other hand, the area indicated by the counted value of the first input area counter 743*a* is an area into which no segment data has been read yet since the start of tone generation, or an area which stores segment data whose compressed data has been already decoded. More specifically, because new segment data can be read into this area, it is considered that the cache memory has free space.

In the first mode, therefore, if an output signal output by the first comparing device 747*a* indicates that the counted values match between the first input area counter 743*a* and the first output area counter 744*a*, the segment data input circuit 741 will not read any segment data. If an output signal output by the first comparing device 747*a* indicates that the counted values mismatch between the first input area counter 743*a* and the first output area counter 744*a*, the segment data input circuit 741 reads two continuous sets of segment data into the area indicated by the first input area counter 743*a*, with the above-calculated reading address being defined as the top.

Furthermore, the cache circuit 740 has a second comparing device 747*b* which compares counted values between the second input area counter 743*b* and the second output area counter 744*b* and supplies a signal indicative of whether the counted values match with each other or not to the segment data input circuit 741. In the second mode, similarly to the above-described first mode, in a case where the counted value of the second input area counter 743*b* matches with the value of the second output area counter 744*b*, the match between the two counters indicates that there is no free space in the cache memory. In a case where the counted value of the second input area counter 743*b* does not match with the counter value of the second output area counter 744*b*, the mismatch between the two counters indicates that there is free space in the cache memory. The reason for this is the same as the first mode. Therefore, if an output signal output by the second comparing device 747*b* indicates that the counted values match between the second input area counter 743*b* and the second output area counter 744*b*, the segment data input circuit 741 will not read any segment data. If an output signal output by the second comparing device 747*b* indicates that the counted values mismatch between the second input area counter 743*b* and the second output area counter 744*b*, the segment data input circuit 741 reads two continuous sets of segment data into the area indicated by the second input area counter 743*b*, with the above-calculated reading address being defined as the top.

After the segment data input circuit 741 has read the two segment data sets into the cache memory, an input area counter updating circuit 748 increments the counted value of either the first input area counter 743*a* or the second input area counter 743*b* according to the operating mode. The first output area counter 744*a* and the second output area counter 744*b* are controlled by a later-described output area counter updating circuit 749.

The segment data output circuit 742 supplies segment data which has been previously read into the cache memory to the decoding circuit 750 in response to a request made by the decoding circuit 750. At each period obtained by dividing one reproduction period into 256 equal periods, the segment data output circuit 742 supplies segment data requested by the decoding circuit 750 to the decoding circuit 750 for each of the tone generation channels CH0 to CH255.

The segment data output circuit 742 identifies the segment data which is to be supplied to the decoding circuit 750 as follows. The output area counter updating circuit 749 inputs counter update information UPD including the segment data number indicative of the segment data number supplied last in the immediately preceding reproduction period to the decoding circuit 750 to a comparison register which is not shown. In accordance with operating mode information MD supplied from the channel setting circuit 710, the segment data output circuit 742 reads the counted value counted at the end of the immediately preceding reproduction period from the output area counter memory 746 to the first output area counter 744*a* or the second output area counter 744*b*.

The segment data output circuit 742 and the output area counter updating circuit 749 then input request data information REQ from the decoding circuit 750. The output area counter updating circuit 749 compares respective values of the first bit of the counter update information UPD and the request data information REQ. If these values are different with each other, the counted value of the first output area counter 744*a* or the second output area counter 744*b* is incremented in accordance with the operating mode. If the LSB of the request data information REQ stored in the two-word area indicated by the first output area counter 744*a* or the second output area counter 744*b* is "0", the segment data output circuit 742 supplies the segment data stored in the storage area of the low-order address side to the decoding circuit 750. If the LSB of the request data information REQ is "1", the segment data output circuit 742 supplies the segment data stored in the storage area of the high-order address side to the decoding circuit 750. The output area counter updating circuit 749 inputs the request data information REQ as the counter update information UPD to the comparison register. In a case where a plurality of pieces of request data information REQ are supplied from the decoding circuit 750 within a processing period of a tone generation channel, more specifically, the second piece of request data information REQ is processed by use of the first piece of request data information REQ as the counter update information UPD.

b7. Decoding Circuit

The decoding circuit 750 retrieves compressed data and a parameter included in the segment data previously read into the cache memories CM0 to CM255. The decoding circuit 750 shifts the retrieved compressed data to figure out residual data, and calculates a predicted value by linear prediction by use of the latest sample value of the decoded sample values. The decoding circuit 750 then adds the calculated residual data to the calculated predicted value to obtain a new sample value. The decoding circuit 750 calculates respective new sample values for the tone generation channels CH0 to CH255 at each period of 256 equally divided periods of a sampling cycle.

Figure 8:
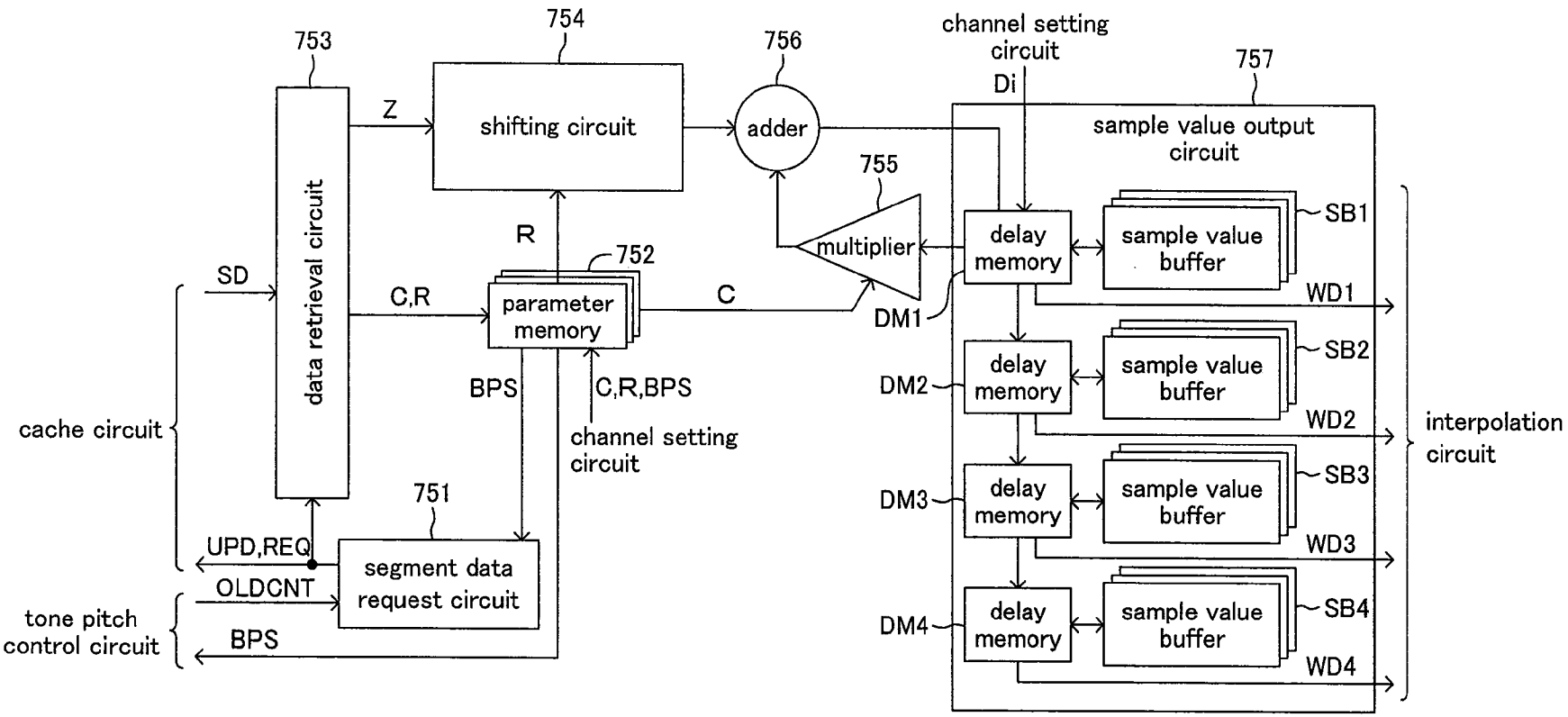
FIG. 8 is a block diagram indicative of a concrete configuration of a decoding circuit indicated in FIG. 2.

As indicated in FIG. 8, the decoding circuit 750 has a segment data request circuit 751 which requests, by use of the processed data information OLDCNT and the decoding number INCO supplied from the tone pitch control circuit 730, the segment data output circuit 742 of the cache circuit 740 to supply segment data which includes compressed data which is to be used for the next decoding. In a case where the decoding number INCO is "2", the decoding circuit 750 requests the first set of segment data to figure out the first sample value by use of the supplied segment data, and then requests the second set of segment data to figure out the second sample value by use of the supplied segment data.

The segment data request circuit 751 reads a frame number, a segment number and an index number which configure the processed data information OLDCNT supplied from the tone pitch control circuit 730 into a buffer memory which is not shown. The segment data request circuit 751 then supplies the segment number read into the buffer memory as the counter update information UPD to the output area counter updating circuit 749 of the cache circuit 740. At each start of the calculation of a sample value, the segment data request circuit 751 increments the index number read into the buffer memory. In decoding of compressed data included in the immediately preceding frame data (hereafter simply referred to as decoding of frame data), a data retrieval circuit 753 stores the linear prediction coefficient C and the denormalization coefficient R which are the parameters to be used for decoding the current frame data in a parameter memory 752. In a case where the frame data which is to be decoded is the top frame data FD0, the linear prediction coefficient C and the denormalization coefficient R are written into the parameter memory 752 by the channel setting circuit 710. In a case where the above-described increment of the index number results in the index number which is the same value as the value of the format data BPS, the segment data request circuit 751 increments the segment number by "1", and sets the index number at "0". In a case where the increment of the segment number results in "4", the frame number is incremented by "1", with the segment number being set at "0".

After the above-described increment of index number, the segment data request circuit 751 supplies the segment number as the request data information REQ to the segment data output circuit 742 and the output area counter updating circuit 749 of the cache circuit 740. In response to the supply of the segment number, the segment data output circuit 742 supplies segment data stored in an area corresponding to the request data information REQ to the decoding circuit 750 as described above.

The decoding circuit 750 has the data retrieval circuit 753. The data retrieval circuit 753 retrieves compressed data and a parameter from the segment data supplied from the segment data output circuit 742. For the retrieval of compressed data, by use of the index number, the data retrieval circuit 753 retrieves one of the two sets of compressed data included in the segment data. In a case where the index number is "0", more specifically, the compressed data set of the LSB side of the segment data is retrieved. In a case where the index number is "1", the compressed data set of the MSB side of the segment data is retrieved. To the data retrieval circuit 753, as described above, the segment data sets $SD_0$ to $SD_3$ are supplied in this order, whereas the linear prediction coefficient C is configured by the parameters $P_0$ to $P_2$ which correspond to the respective top four bits of the segment data sets $SD_0$ to $SD_2$. If the segment data number is any one of "0" to "2", therefore, the data retrieval circuit 753 stores corresponding top four bits of the input segment data set (that is, corresponding one of the parameters $P_0$ to $P_2$) in the buffer memory which is not shown. If the segment data number is "3", the data retrieval circuit 753 stores the top four bits (that is, the parameter $P_3$) of the input segment data set in the buffer memory. At the completion of the decoding of the respective frame data sets, the data retrieval circuit 753 adds a value obtained by multiplying the parameter $P_1$ by 16 to a value obtained by multiplying the parameter $P_0$ by 256, and further adds the added result to the parameter $P_2$ to obtain the linear prediction coefficient C. The data retrieval circuit 753 then writes the obtained linear prediction coefficient C in the parameter memory 752, and also writes the parameter $P_3$ as the denormalization coefficient R in the parameter memory 752.

The decoding circuit 750 also has a shifting circuit 754, a multiplier 755 and an adder 756. The shifting circuit 754 reads out the denormalization coefficient R stored in the parameter memory 752. The shifting circuit 754 then shifts up the compressed data supplied from the data retrieval circuit 753 by the value of the denormalization coefficient R to obtain residual data to supply the obtained residual data to the adder 756.

For decoding a new sample value WD0, the multiplier 755 reads a latest sample value WD1 which is stored in a delay memory DM1 which will be described in detail later, and is included in sample values which have been already decoded. The multiplier 755 also reads the linear prediction coefficient C stored in the parameter memory 752. The multiplier 755 then multiplies the sample value WD1 by the linear prediction coefficient C to obtain a predicted value to output the predicted value to the adder 756. The adder 756 adds the residual data supplied from the shifting circuit 754 to the predicted value supplied from the multiplier 755 to obtain the new sample value WD0 to output the obtained sample value WD0 to a sample value output circuit 757.

The decoding circuit 750 also has the sample value output circuit 757. The sample value output circuit 757 has delay memories DM1 to DM4 which store the latest four sample values WD1 to WD4 of decoded sample values, respectively. Among the sample values WD1 to WD4, the newest sample value is the sample value WD1, while the second and later newest sample values are referred to as the sample values WD2 to WD4 in this order. At each supply of the new sample value WD0 from the adder 756, the sample value output circuit 757 transfers the sample values WD1 to WD3 stored in the delay memories DM1 to DM3 as the sample values WD2 to WD4 to the delay memories DM2 to DM4, respectively, to store the new sample value WD0 as the sample value WD1 in the delay memory DM1. At the time of the start of tone-generation in the respective tone generation channels, however, an initial sample value Di written into the real-time control register 712 is written into the delay memory DM1 by the channel setting circuit 710.

The sample value output circuit 757 has sample value buffers SB1 to SB4. The sample value buffers SB1 to SB4, which are provided for the respective tone generation channels, are connected to the delay memories DM1 to DM4, respectively. After the completion of the decoding at the respective tone generation channels in each reproduction period, the sample value output circuit 757 transfers sample values stored in the delay memories DM1 to DM4 to the sample value buffers SB1 to SB4 to store the transferred sample values in the sample value buffers SB1 to SB4. At the start of the decoding in the following reproduction period, the sample value output circuit 757 reads the latest four sample values of a corresponding tone generation channel from the sample value buffers SB1 to SB4 into the delay memories DM1 to DM4, respectively. As described in detail later, however, in a case where the pitch magnification is "1.0" or more, one or more new sample values WD0 are supplied from the adder 756 to the sample value output circuit 757 at each reproduction period. As a result, a sample value stored in the delay memory DM4 is updated at each reproduction period. In the case where the pitch magnification is "1.0" or more, more specifically, the sample value stored in the sample value buffer SB4 and read into the delay memory DM4 will not be used for interpolation which will be explained next. In the case where the pitch magnification is "1.0" or more, therefore, the sample value output circuit 757 may transfer sample values stored in the delay memories DM1 to DM3 to the sample value buffers SB1 to SB3 at the completion of decoding at the respective tone generation channels in each reproduction period to store the transferred sample values in the sample value buffers SB1 to SB3, and read the latest three sample values of a corresponding tone generation channel from the sample value buffers SB1 to SB3 into the delay memories DM1 to DM3, respectively, at the start of decoding in the following reproduction period. In the later-described operating explanation, it is assumed that the sample value output circuit 757 is configured to use the latest three sample values as described above. In a case where the pitch magnification is less than "1.0" though the present invention is not directly related to such a case, there can be reproduction periods in which the new sample value WD0 will not be supplied from the adder 756 to the sample value output circuit 757. In this case, the interpolation which will be explained next will be performed by use of the latest four sample values read from the sample value buffers SB1 to SB4 into the delay memories DM1 to DM4, respectively.

The sample value output circuit 757 outputs the sample values WD1 to WD4 stored in the delay memories DM1 to DM4 to the interpolation circuit 760 at the completion of the decoding at the respective tone generation channels. In the second mode, however, even after the completion of the decoding at the tone generation channel CHa, the sample value output circuit 757 will not output the sample values WD1 to WD4 to the interpolation circuit 760, but outputs the sample values WD1 to WD4 to the interpolation circuit 760 after the completion of the decoding at the tone generation channel CHb.

b8. Interpolation Circuit

Figure 9:
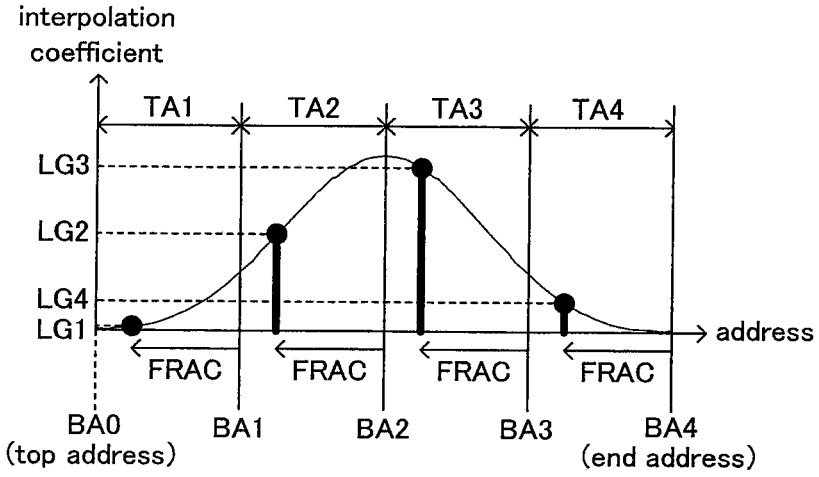
FIG. 9 is a conceptual diagram of an interpolation table.

By use of the four sample values WD1 to WD4 supplied from the decoding circuit 750 and the interpolation coefficient calculation data FRAC supplied from the tone pitch control circuit 730, the interpolation circuit 760 performs interpolation to obtain a sample value corresponding to the accumulated value of the pitch magnification. More specifically, by use of an interpolation coefficient table representative of the relationship between interpolation coefficients LG1 to LG4 which are to be multiplied by the sample values WD1 to WD4, respectively, and interpolation coefficient calculation data FRAC as indicated in FIG. 9, the interpolation circuit 760 obtains the interpolation coefficients LG1 to LG4. The interpolation coefficient table is stored in a memory which is not shown, while Lagrange interpolation coefficients are stored in addresses corresponding to the interpolation coefficient calculation data FRAC. As for the storage area where the interpolation coefficient table is stored, the interpolation coefficient LG1 is stored in an area TA1 which makes up the top one quarter of the storage area where the interpolation coefficient table is stored, while the interpolation coefficient LG2 is stored in an area TA2 which makes up one quarter which follows the area TA1. In an area TA3 which makes up one quarter which follows the area TA2, the interpolation coefficient LG3 is stored, while in an area TA4 which makes up the last one quarter, the interpolation coefficient LG4 is stored.

First, the interpolation circuit 760 calculates an address offset value in accordance with the interpolation coefficient calculation data FRAC. Relative to an end address BA1 of the area TA1, the interpolation circuit 760 reads out a value stored in an address offset toward the top address BA0 by the calculated address offset value as the interpolation coefficient LG1. Similarly to the interpolation coefficient LG1, relative to respective end addresses BA2, BA3, and BA4 of the areas TA2, TA3, and TA4, the interpolation circuit 760 reads out values stored in addresses offset toward the respective top addresses by the calculated address offset value as the interpolation coefficients LG2, GL3, and LG4, respectively. The interpolation circuit 760 multiplies the sample values WD4 to WD1 by the interpolation coefficients LG1 to LG4 obtained by use of the interpolation coefficient table, respectively, to combine the multiplied results to figure out a sample value corresponding to the accumulated value of the pitch magnification. The interpolation circuit 760 then supplies the obtained sample value to the filter circuit 770. In a case where the interpolation coefficient calculation data FRAC is "0", however, the interpolation coefficient LG2 is set at "1.0", with the interpolation coefficient LG1, the interpolation coefficient LG3 and the interpolation coefficient LG4 being set at "0", respectively. In this case, that is, the sample value WD3 is supplied directly to the filter circuit 770.

b9. Filter Circuit

The filter circuit 770 combines a cutoff frequency control signal supplied from the envelope signal generation circuit 721 and a modulation signal supplied from the low frequency signal generation circuit 722 to figure out a cutoff frequency for a filter. To the filter circuit 770, filter control parameters are also supplied from the channel setting circuit 710. The filter control parameters include filter selection information for selecting the type of filter (for example, high pass filter, low pass filter, or the like). The filter circuit 770 sets the cutoff frequency for a filter selected in accordance with the filter selection information at the calculated cutoff frequency, and processes digital musical tone data supplied from the interpolation circuit 760 with this filter to output the processed digital musical tone data to the tone volume control circuit 780.

b10. Tone Volume Control Circuit

The tone volume control circuit 780 combines the tone volume control signal supplied from the envelope signal generation circuit 721 and the modulation signal supplied from the low frequency signal generation circuit 722 to figure out the tone volume of a musical tone signal which is to be generated. The tone volume control circuit 780 amplifies the digital musical tone data supplied from the filter circuit 770 in accordance with the calculated tone volume to output the amplified musical tone data to the channel accumulation circuit 790.

b11. Channel Accumulation Circuit

The channel accumulation circuit 790 accumulates digital musical tone signals output from the respective tone generation channels CH0, CH1, . . . CH255 in each reproduction period to output the accumulated digital musical tone signal to the sound system 800. The channel accumulation circuit 790 has an effect processing circuit which adds an effect (for example, chorus, reverb, etc.) which is to be applied commonly to the digital musical tone signals output from the respective tone generation channels.

c. Computer Portion 900

Figure 10:
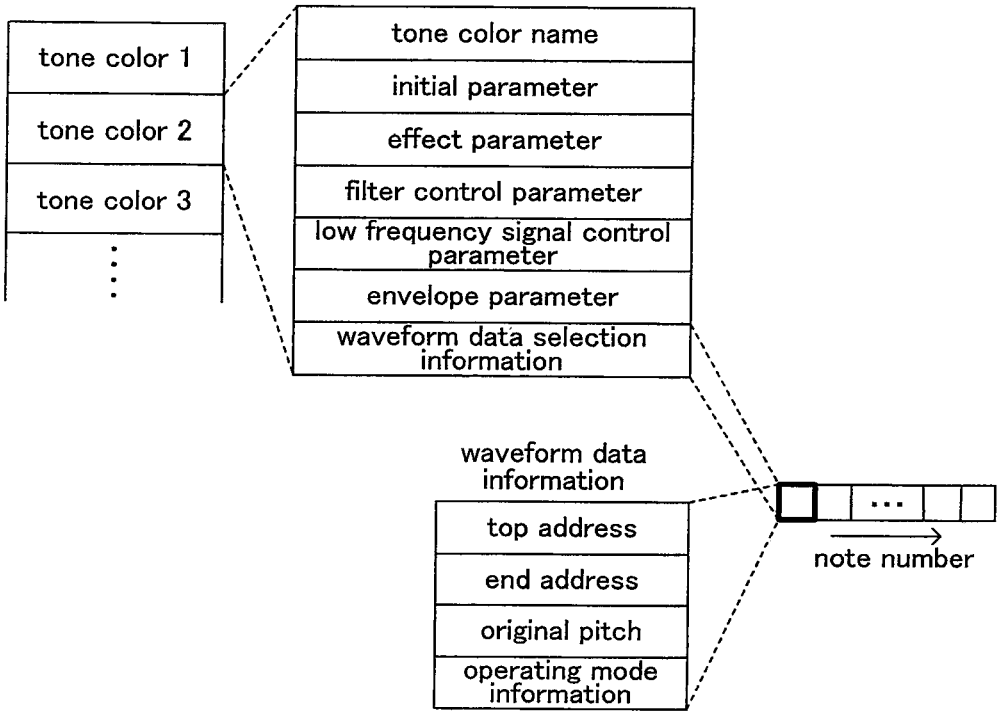
FIG. 10 is a memory map indicative of a configuration of voice data.

Next, the configuration of the computer portion 900 will be explained. Particularly, programs and various kinds of data stored in the ROM 903 will be explained in detail. In the ROM 903, a voice data list is stored. As indicated in FIG. 10, the voice data list is formed of voice data specified for each tone color.

The voice data includes tone color name information, an initial parameter, an effect parameter, a filter control parameter, a low frequency signal control parameter, an envelope parameter and waveform data selection information on the selection of waveform data. The tone color name information represents the name of a tone color. The initial parameter is formed of the format data BPS indicative of the number of compressed data sets included in a set of segment data, the linear prediction coefficient C, the denormalization coefficient R and the initial sample value Di used for decoding the top frame data $FD_0$, and the like. The effect parameter is a parameter for adding a common effect to each musical tone signal output from the tone generation channels in the channel accumulation circuit 790.

The filter control parameter is a parameter for controlling the filter circuit 770. The low frequency signal control parameter is a parameter for controlling the low frequency signal generation circuit 722. The envelope parameter is a parameter for generating various kinds of envelopes. The waveform data selection information is a table indicative of the correlation between note number NN and waveform data information representative of information on waveform data to be selected. The waveform data information is formed of a top address, an end address and an original pitch and an operating mode of waveform data.

In the ROM 903, furthermore, a tone generation reservation program (FIG. 11) and a parameter update periodic processing program (FIG. 12) are also stored. The tone generation reservation program, which is executed in response to the generation of a note-on event, is a program for keeping a tone generation channel for generating a musical tone signal corresponding to the note-on event, and writing parameters relating to the musical tone signal which is to be generated. For the execution of the tone generation reservation program, regardless of whether the kept tone generation channel is currently being used for processing for the other tone generation, the CPU 901 writes parameters on a musical tone signal corresponding to the generated note-on event into the reservation register 711 of the tone generator 700. By the writing of the parameters, the reservation of the tone generation is completed. In other words, the CPU 901 terminates the tone generation reservation program without waiting for the start of the tone generation in the tone generation channel reserved by the execution of the tone generation reservation program.

The parameter update periodic processing program is triggered by an interrupt signal supplied from the timer 902. The parameter update periodic processing program is a program for updating, in certain periods, parameters written into the real-time control register 712 in order to vary, in real time, musical tone signals generated in the respective tone generation channels which are currently generating musical tones.

Figure 11:
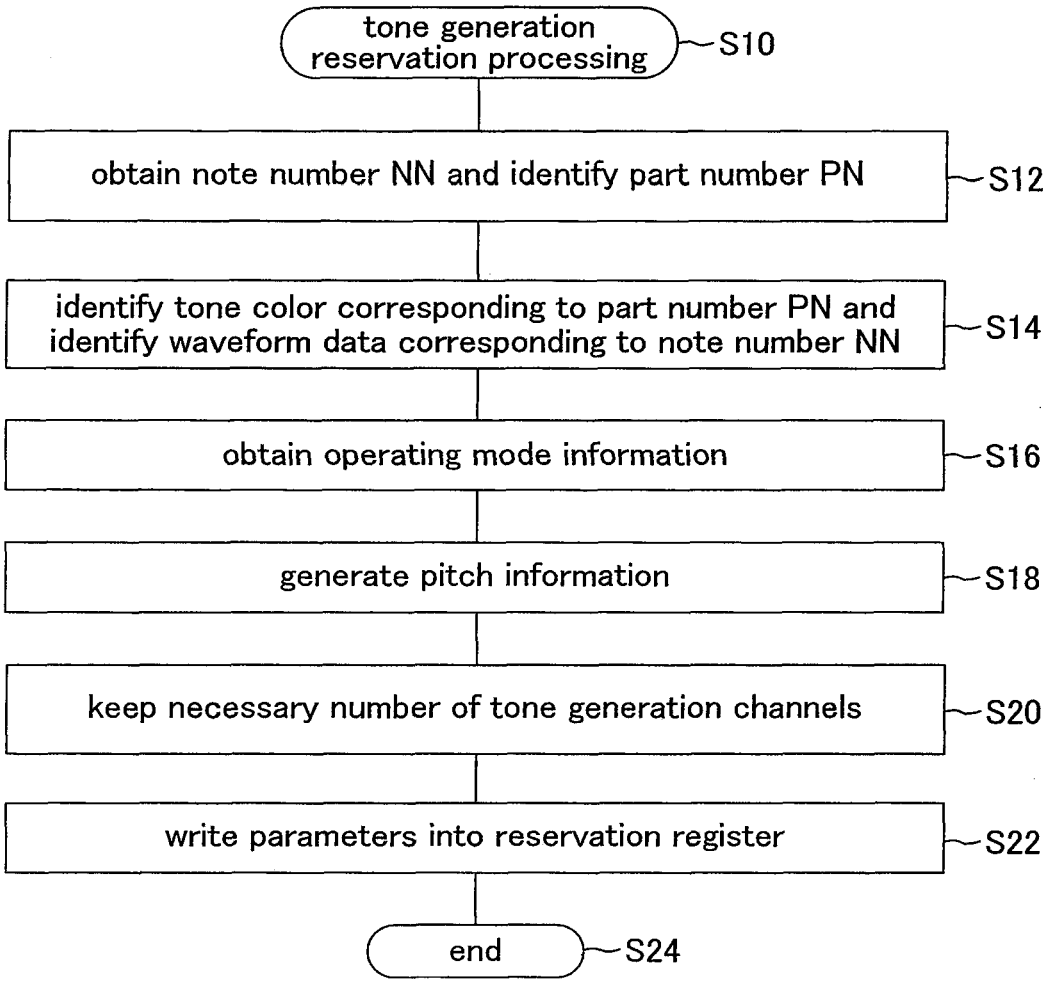
FIG. 11 is a flowchart of a tone generation reservation program.
Figure 12:
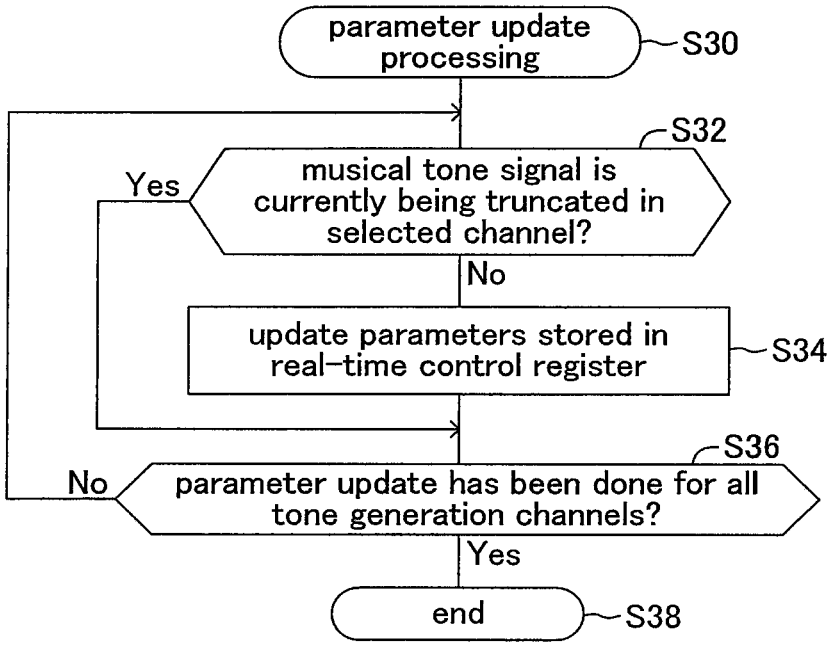
FIG. 12 is a flowchart of a parameter update processing program.

Next, the operation of the electronic musical instrument configured as described above will be explained. In response to the generation of a note-on event made by a player's depression of a key of the keyboard 100, the CPU 901 starts the tone generation reservation program in step S10 as indicated in FIG. 11. In step S12, the CPU 901 obtains the note number NN indicative of the depressed key in accordance with musical performance information supplied from the operating element interface circuit 400. The keyboard 100 is previously assigned any one of musical performance parts. Furthermore, key ranges may be assigned musical performance parts, respectively. The CPU 901 identifies a part number PN indicative of a musical performance part to which the depressed key belongs on the basis of the generation of the note-on event made by the key-depression on the keyboard 100 and the obtained note number NN.

In step S14, the CPU 901 refers to the voice data list to identify a corresponding tone color assigned to the part identified in step S12, and also refers to the waveform data selection information on the identified tone color to identify waveform data corresponding to the obtained note number NN. In step S16, the CPU 901 refers to waveform data information of the identified waveform data to obtain operating mode information. In step S18, the CPU 901 obtains an original pitch in accordance with waveform data information of the identified waveform data. In step S18, the CPU 901 then generates pitch information including the obtained note number NN and the original pitch. In step S20, the CPU 901 keeps the necessary number of tone generation channels in accordance with the obtained operating mode information. More specifically, if the operating mode indicated by the obtained operating mode information is the first mode, the CPU 901 keeps one tone generation channel. If it is the second mode, the CPU 901 keeps two tone generation channels. In the case of the second mode, the CPU 901 keeps two tone generation channels whose tone generation channel numbers are continuous. Among all the tone generation channels, a tone generation channel (hereafter referred to as a free tone generation channel) whose tone volume level at which a musical tone signal is being generated is lower than a certain low level is selected as a tone generation channel which is to generate a musical tone corresponding to the note-on event. In a case where there is no free channel, one tone generation channel is selected in accordance with a certain rule to truncate the selected tone generation channel. For instance, a tone generation channel having the lowest tone volume level is selected to be truncated. Alternatively, a tone generation channel generating a musical tone signal corresponding to the oldest note-on event may be selected to be truncated.

After keeping the necessary number of tone generation channels for generating a musical tone, the CPU 901 proceeds to step S22 to write various parameters on a musical tone signal which is to be generated into the reservation register 711 of the tone generation channel kept by the step S20. More specifically, the CPU 901 retrieves the effect parameter, the envelope parameter, the top and end addresses of the waveform data, and the like from the voice data of the tone color identified in step S14 to write the retrieved parameters as well as the operating mode information obtained in the step S16 and the pitch information generated in the step S18 into the reservation register 711. In the second mode, however, the CPU 901 writes the same parameters into the reservation registers 711 of the kept two tone generation channels, respectively. In step S22, furthermore, the CPU 901 also writes key-on information indicative of the start of the tone generation in the kept tone generation channel into the reservation register 711. In step S24, the CPU 901 terminates the tone generation reservation program. By these steps, the reservation of tone generation for the note-on event is completed.

If it has been detected that the tone volume level of the tone generation channel whose reservation register 711 has the key-on information and the various parameters had decreased to a damp level or below, the channel setting circuit 710 of the tone generator 700 copies the various parameters written into the reservation register 711 of the tone generation channel to the real-time control register. The channel setting circuit 710 then supplies the copied parameters to the corresponding tone generation channel to start processing for tone generation in the tone generation channel.

Next, the parameter update periodic processing program will be explained. The parameter update periodic processing program is a program for writing parameters and the like for generating envelopes which vary the tone pitch, the tone color and the tone volume of a musical tone which is currently being generated. In step S30 of FIG. 12, the CPU 901 starts the parameter update periodic processing. In step S32, the CPU 901 selects a tone generation channel CHn (n=0, 1, . . . , 255), and judges whether a musical tone signal which is currently being generated in the tone generation channel CHn is being currently truncated or not. If a musical tone signal is being truncated, the CPU 901 proceeds to step S36 which will be explained later. If any musical tone signals are not being truncated, the CPU 901 proceeds to step S34 to update parameters stored in the real-time control register 712.

Examples of the writing of parameters in the step S34 include cases where the tone pitch, the tone color, the tone volume or the like of a musical tone which is currently being generated is to vary in accordance with musical performance information generated in response to the player's manipulation of the panel operating elements 200, the pedal operating elements 300 or the like, or musical performance information transmitted from a MIDI-capable external apparatus through the external interface circuit 1100. In such cases, the CPU 901 writes the parameters of a corresponding tone generation channel into the real-time control register 712 in accordance with the musical performance information to update the parameters. The updated parameters as well as the other parameters which have not been updated are output to the respective circuits which configure the tone generator 700 within a processing period of the corresponding tone generation channel by the channel setting circuit 710.

After the update of the parameters of the tone generation channel CHn, the CPU 901 proceeds to step S36 to judge whether the update of the parameters has been completed for all the tone generation channels. If there are any remaining tone generation channels, the CPU 901 repeats the steps from the step S32 to the step S34 to update the parameters of all the tone generation channels. After the parameter update for all the tone generation channels has completed, the CPU 901 terminates the parameter update periodic processing program in step S38.

Figure 13:
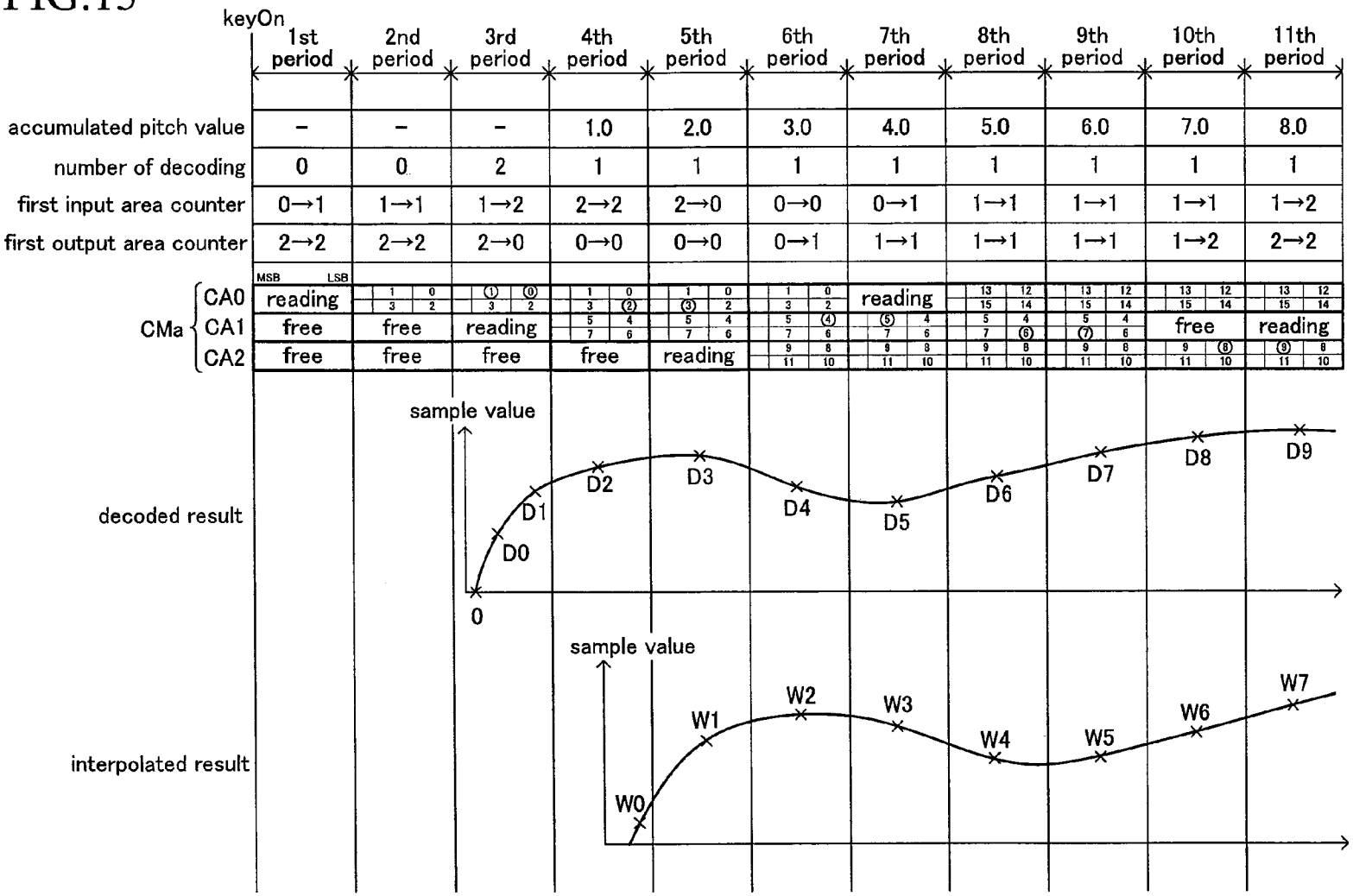
FIG. 13 is a time chart indicative of operation of the tone generator of a case in which the pitch magnification is "1.0"

Next, the operation of the tone generation channel CHa ("a" is an even number) which is to generate the waveform data indicated in FIG. 4 at the same pitch as the original pitch (that is, the pitch magnification is "1.0") in the first mode will be explained, with reference to FIG. 13. At the start of processing for the tone generation channel CHa in the first period which is the first reproduction period after the start of the processing for tone generation, the input area counter updating circuit 748 resets the value of the first input area counter 743*a* to "0", while the output area counter updating circuit 749 resets the value of the first output area counter 744*a* to "2". Hereafter, reproduction periods following the first period will be referred to as the second period, the third period and the like, respectively. Furthermore, the tone pitch control circuit 730 resets the frame data number of the processed data information OLDCNT to "n", the segment data number to "3", and the index number to "1", respectively.

At the start of the processing for tone generation, the channel setting circuit 710 writes the format data BPS, and the linear prediction coefficient C and the denormalization coefficient R used for decoding of the top frame data $FD_0$ into the parameter memory 752 of the decoding circuit 750. At the start of the processing for tone generation, in addition, the channel setting circuit 710 writes the initial sample value Di into the sample value buffer SB1. At the start of the processing for tone generation, furthermore, the channel setting circuit 710 supplies the top address of the waveform data to the segment data input circuit 741.

The segment data input circuit 741 reads two sets of segment data the top one of which is the segment data set stored in the top address supplied from the channel setting circuit 710 into the area CAO of the cache memory CMa to increment the first input area counter 743*a*. As a result, the value indicated by the first input area counter 743*a* becomes "1". Furthermore, the segment data input circuit 741 increments a relative address counter. As a result, the value indicated by the relative address counter becomes "2". In FIG. 13, compressed data read into the cache memory CMa is indicated only by the numbers of the compressed data, while the numbers of compressed data which is to be decoded in the respective reproduction periods are circled.

Although the channel setting circuit 710 supplies the decoding number INCO indicative of the number of decoding in the first period to the segment data request circuit 751 of the decoding circuit 750, the value of the decoding number INCO is "0". In the first period, therefore, the decoding circuit 750 will not decode any sample values, without operating the interpolation circuit 760, the filter circuit 770 and the tone volume control circuit 780. Therefore, the value of the first output area counter 744*a* will not be updated, but remains "2".

The tone pitch control circuit 730 inputs the decoding number INCO and the interpolation coefficient calculation data FRAC of the next second period from the channel setting circuit 710. The value of the decoding number INCO is "0", while the value of the interpolation coefficient calculation data FRAC is "0". Because any sample values have not been decoded in the first period as described above, the tone pitch control circuit 730 will not update the processed data information OLDCNT. Therefore, the processed data information OLDCNT remains the initialized state. More specifically, the index data number is "1", the segment data number is "3", and the frame data number is "n". The tone pitch control circuit 730 stores the above-described decoding number INCO, processed data information OLDCNT and interpolation coefficient calculation data FRAC to supply the decoding number INCO and the processed data information OLDCNT to the decoding circuit 750, and to supply the interpolation coefficient calculation data FRAC to the interpolation circuit 760 in the second period.

Next, the operation in the second period will be described. Because the tone generation channel CHa is a tone generation channel having an even number, the segment data input circuit 741 will not read any segment data in the second period even if the cache memory CMa has free space. Therefore, the value indicated by the first input area counter 743*a* remains "1".

The segment data request circuit 751 inputs the decoding number INCO and the processed data information OLDCNT from the tone pitch control circuit 730. Because the value of the decoding number INCO is "0", the decoding circuit 750 will not decode any compressed data in the second period as well. Therefore, the interpolation circuit 760, the filter circuit 770 and the tone volume control circuit 780 will not operate. Furthermore, the value of the first output area counter 744*a* will not be updated, but remains "2".

The tone pitch control circuit 730 supplies the decoding number INCO and the processed data information OLDCNT to the decoding circuit 750, and also supplies the interpolation coefficient calculation data FRAC to the interpolation circuit 760, while the tone pitch control circuit 730 inputs the decoding number INCO and the interpolation coefficient calculation data FRAC of the third period from the channel setting circuit 710. The value of this decoding number INCO is "2", while the value of the interpolation coefficient calculation data FRAC is "0". Because any compressed data has not been decoded in the second period as described above, the tone pitch control circuit 730 will not update the processed data information OLDCNT. Therefore, the index data number remains "1", the segment data number remains "3", and the frame data number remains "n". The tone pitch control circuit 730 in which the above-described decoding number INCO, processed data information OLDCNT and interpolation coefficient calculation data FRAC are stored supplies the decoding number INCO and the processed data information OLDCNT to the decoding circuit 750, and supplies the interpolation coefficient calculation data FRAC to the interpolation circuit 760 in the third period.

Next, the operation in the third period will be described. By use of the value indicated by the relative address counter and the value of the top address, the segment data input circuit 741 calculates the absolute address of segment data which is to be input. Because the value of the first input area counter 743*a* is "1" with the value of the first output area counter 744*a* being "2", the first comparing device 747*a* supplies a signal indicating that there is free space in the cache memory CMa to the segment data input circuit 741. Therefore, the segment data input circuit 741 inputs the two sets of segment data whose top address is the above-calculated address in the area CA1 corresponding to the value indicated by the first input area counter 743*a*. The input area counter updating circuit 748 increments the value indicated by the first input area counter 743*a* by "1". By this increment, the value indicated by the first input area counter 743*a* becomes "2". Furthermore, the segment data input circuit 741 increments the relative address counter by "2". By this increment, the value indicated by the relative address counter becomes "4".

The segment data request circuit 751 inputs the decoding number INCO and the processed data information OLDCNT from the tone pitch control circuit 730. Because the value of the decoding number INCO is "2", the decoding circuit 750 decodes the two sets of compressed data in the third period. First, the segment data request circuit 751 supplies the segment data number included in the processed data information OLDCNT input from the tone pitch control circuit 730 as the counter update information UPD to the output area counter updating circuit 749. The value of the counter update information UPD is "3". The output area counter updating circuit 749 inputs the counter update information UPD to the comparison register.

The decoding circuit 750 starts decoding the first compressed data. The segment data request circuit 751 increments the index number included in the processed data information OLDCNT input from the tone pitch control circuit 730 by "1". Because the index number input from the tone pitch control circuit 730 is "1", the index number will be incremented to be "2" by the above-described increment. In this embodiment, the value of the format data BPS is "2". As a result, the value of the index number coincides with the value of the format data BPS. Therefore, the segment data request circuit 751 sets the index number at "0", and increments the segment data number and the frame data number by "1", respectively. Resultantly, the respective values of the segment data number and the frame data number are "0". The segment data request circuit 751 supplies the request data information REQ to the segment data output circuit 742 and the output area counter updating circuit 749. Because the value of the segment data number is "0", the value of the request data information REQ is "0". The output area counter updating circuit 749 compares the first bit of the counter update information UPD (=3) input to the comparison register with the first bit of the request data information REQ (=0). Because the two values disagree with each other, the output area counter updating circuit 749 increments the first output area counter 744*a*. By this increment, the value of the first output area counter 744*a* becomes "0". The segment data output circuit 742 then selects, from the two segment data sets stored in the area CAO corresponding to the value indicated by the first output area counter 744*a*, a segment data set placed on the low-order address side (that is, the area CA00) corresponding to the value of the zeroth bit of the request data information REQ to supply the selected set of segment data to the data retrieval circuit 753. The output area counter updating circuit 749 then inputs and stores the request data information REQ in the comparison register to compare the stored request data information REQ with new request data information REQ supplied from the decoding circuit 750 for the decoding of the second sample value.

The data retrieval circuit 753 retrieves compressed data corresponding to the index number from the supplied segment data. More specifically, because the index number is "0", the data retrieval circuit 753 retrieves compressed data $Z_0$ of the LSB side of the segment data. The data retrieval circuit 753 then supplies the retrieved compressed data $Z_0$ to the shifting circuit 754. The data retrieval circuit 753 also retrieves parameter $P_0$ from the supplied segment data to store the parameter $P_0$ in a buffer memory which is not shown. The shifting circuit 754 reads the denormalization coefficient R from the parameter memory 752 to shift up the compressed data $Z_0$ by the value represented by the denormalization coefficient R to figure out residual data. The multiplier 755 reads the linear prediction coefficient C from the parameter memory 752, and also reads the initial sample value Di from the delay memory DM1. The multiplier 755 then multiplies the linear prediction coefficient C by the initial sample value Di to obtain a predicted value to supply the obtained predicted value to the adder 756. The adder 756 adds the residual data supplied from the shifting circuit 754 to the predicted value supplied from the multiplier 755 to obtain the sample value D0 to supply the obtained sample value DO to the sample value output circuit 757. The sample value output circuit 757 stores the initial sample value Di in the delay memory DM2, and stores the sample value D0 in the delay memory DM1.

The decoding circuit 750 then starts decoding the second set of compressed data. First, the segment data request circuit 751 increments the index number by 1. By this increment, the index number becomes "1". Because the index number is different from the value of the format data BPS, the segment data number and the frame data number remain "0", respectively. Similarly to the above-described decoding of the first set of compressed data, therefore, the value of the request data information REQ is "0". Because the value of the first bit of the first request data information REQ (=0) stored in the comparison register is identical to the value of the first bit of the second request data information REQ (=0), the output area counter updating circuit 749 of the cache circuit 740 will not update the first output area counter 744*a*. Because the value of the request data information REQ is identical to that used for the decoding of the first compressed data, the segment data output circuit 742 supplies the same segment data as that used for the decoding of the first compressed data to the data retrieval circuit 753. Because the index number is "1", the data retrieval circuit 753 retrieves compressed data $Z_1$ placed on the MSB side of the supplied segment data. Similarly to the decoding of the first compressed data, the shifting circuit 754, the multiplier 755 and the adder 756 decode the sample value D1 by use of the linear prediction coefficient C and the denormalization coefficient R stored in the parameter memory 752 and the sample value D0 stored in the delay memory DM1.

The sample value output circuit 757 stores the initial sample value Di and the sample value D0 stored in the delay memory DM2 and the delay memory DM1, respectively, in the delay memory DM3 and the delay memory DM2, respectively, and also stores the sample value D1 in the delay memory DM1. By decoding the two sets of compressed data until the third period, two sample values have been figured out. Although four sample values are necessary for the interpolation circuit 760 to perform interpolation, only two sample values have been figured out as described above. Therefore, the sample value output circuit 757 will not supply the sample values to the interpolation circuit 760 in the third period. Resultantly, the sample value output circuit 757 transfers the respective sample values stored in the delay memories DM1 to DM3 to the sample value buffers SB1 to SB3 to store the sample values in the sample value buffers until the next reproduction period. Because the sample values will not be supplied to the interpolation circuit 760 from the decoding circuit 750 as described above, the interpolation circuit 760 will not operate.

The tone pitch control circuit 730 supplies the decoding number INCO and the processed data information OLDCNT to the decoding circuit 750, supplies the interpolation coefficient calculation data FRAC to the interpolation circuit 760, and then inputs the decoding number INCO and the interpolation coefficient calculation data FRAC of the fourth period from the channel setting circuit 710. The value of the input decoding number INCO is "1", while the value of the interpolation coefficient calculation data FRAC is "0". Because the two sets of compressed data have been decoded in the third period, the tone pitch control circuit 730 increments the index number which configures the processed data information OLDCNT by two. By the increment, the index number becomes "1". The segment data number and the frame data number remain "0". The tone pitch control circuit 730 stores the above-described decoding number INCO, processed data information OLDCNT and interpolation coefficient calculation data FRAC to supply the decoding number INCO and the processed data information OLDCNT to the decoding circuit 750 and to supply the interpolation coefficient calculation data FRAC to the interpolation circuit 760 in the fourth period.

Next, the operation in the fourth period will be explained. In the fourth period, similarly to the second period, the segment data input circuit 741 will not read any segment data. Therefore, the value indicated by the first input area counter 743*a* remains "2".

The segment data request circuit 751 inputs the decoding number INCO and the processed data information OLDCNT from the tone pitch control circuit 730. Because the value of the decoding number INCO is "1", the decoding circuit 750 decodes one sample value in the fourth period. First, the sample value output circuit 757 reads the sample values stored in the sample value buffers SB1 to SB3 into the delay memories DM1 to DM3. By the reading of the sample values, the sample value D1, the sample value D0 and the initial sample value Di are stored in the delay memory DM1, the delay memory DM2 and the delay memory DM3, respectively.

Similarly to the third period, the segment data request circuit 751 supplies the segment data number as the counter update information UPD to the output area counter updating circuit 749. Because the segment data number input from the tone pitch control circuit 730 is "0", the value of the counter update information UPD is "0". The segment data request circuit 751 increments the index number. The index number supplied from the tone pitch control circuit 730 is "1". By the above-described increment, therefore, the index number becomes "2", which is the same value as the value of the format data BPS. Resultantly, the segment data request circuit 751 sets the index number at "0", and increments the segment data number by 1. By the increment, the segment data number becomes "1". The frame data number remains "0". Therefore, the value of the request data information REQ which is to be supplied to the output area counter updating circuit 749 of the cache circuit 740 is "1". Because the value of the first bit of the counter update information UPD (=0) is identical to the value of the first bit of the request data information REQ (=1), the output area counter updating circuit 749 will not update the first output area counter 744*a*. More specifically, the value indicated by the first output area counter 744*a* remains "0". Therefore, the segment data output circuit 742 selects, from among the two sets of segment data stored in the area CA0 corresponding to the value indicated by the first output area counter 744*a*, a set of segment data placed on the high-order address side (that is, the area CA01) corresponding to the value of the zeroth bit of the request data information REQ to supply the selected set of segment data to the data retrieval circuit 753. Because the index number is "0", the data retrieval circuit 753 retrieves compressed data $Z_2$ placed on the LSB side of the supplied segment data to supply the retrieved compressed data $Z_2$ to the shifting circuit 754. Furthermore, the data retrieval circuit 753 also retrieves the parameter $P_1$ from the supplied segment data to store the parameter $P_1$ in the buffer memory which is not shown. Similarly to the third period, the shifting circuit 754, the multiplier 755 and the adder 756 figure out the sample value D2.

The sample value output circuit 757 stores the sample value D1, the sample value D0 and the initial sample value Di stored in the delay memory DM1, the delay memory DM2 and the delay memory DM3, respectively, in the delay memory DM2, the delay memory DM3 and the delay memory DM4, respectively, and also stores the sample value D2 in the delay memory DM1. The sample value output circuit 757 then supplies the sample values stored in the delay memories DM1 to DM4 to the interpolation circuit 760. The sample value output circuit 757 then stores the sample values stored in the delay memories DM1 to DM3 in the sample value buffers SB1 to SB3.

The interpolation circuit 760 inputs the interpolation coefficient calculation data FRAC from the tone pitch control circuit 730. Because the value of the interpolation coefficient calculation data FRAC is "0", the interpolation circuit 760 supplies the sample value D0 as initial sample value W0 to the filter circuit 770. The filter circuit 770 filters the supplied sample value D0 to output the filtered sample value D0 to the tone volume control circuit 780. The tone volume control circuit 780 changes the tone volume of the sample value D0 in accordance with the envelope signal and the low frequency signal supplied from the modulation signal generation circuit 720 to output the sample value D0 whose tone volume has been changed to the channel accumulation circuit 790.

The tone pitch control circuit 730 supplies the decoding number INCO and the processed data information OLDCNT to the decoding circuit 750, and also supplies the interpolation coefficient calculation data FRAC to the interpolation circuit 760 to figure out the decoding number INCO and the interpolation coefficient calculation data FRAC for the fifth period. The tone pitch control circuit 730 accumulates the pitch magnification in each of the fourth and later periods to figure out the decoding number INCO and the interpolation coefficient calculation data FRAC of the next reproduction period in accordance with the accumulated result of the pitch magnification. Assume that the accumulated value of the pitch magnification in the third period is "0". Because the pitch magnification of this example is "1.0", the accumulated result of the pitch magnification used in the fourth period is "1.0", with the increase in the integer of the accumulated value being "1". That is, the decoding number INCO used in the fifth period is "1". The value of the interpolation coefficient calculation data FRAC is "0". Because the pitch magnification in this example is "1.0", the decoding number INCO calculated in each of the six and later periods is also "1", with the interpolation coefficient calculation data FRAC also being "0". In FIG. 13, respective calculated results are listed on respective periods which follow the reproduction periods in which the tone pitch control circuit 730 has calculated the accumulated values of the pitch magnification. More specifically, an accumulated value of the pitch magnification is listed on the reproduction period in which a sample value corresponding to the accumulated value is to be output by the interpolation circuit 760.

Because a set of compressed data has been decoded in the fourth period, the tone pitch control circuit 730 increments the index number which configures the processed data information OLDCNT by 1. By this increment, the index number becomes "2", which is the same value as the value of the format data BPS. Therefore, the tone pitch control circuit 730 sets the index number at "0", and increments the segment data number by 1. By this increment, the segment data number becomes "1". However, the frame data number remains "0". The tone pitch control circuit 730 stores the above-described decoding number INCO and processed data information OLDCNT, and the interpolation coefficient calculation data FRAC, and in the fifth period, supplies the decoding number INCO and processed data information OLDCNT to the decoding circuit 750, and also supplies the interpolation coefficient calculation data FRAC to the interpolation circuit 760.

Next, the operation in the fifth period will be explained. The segment data input circuit 741 figures out the absolute address of segment data which is to be input from the waveform memory WM by use of the value of the relative address counter and the value of the top address. At the start of the fifth period, the value indicated by the first input area counter 743*a* is "2", while the value indicated by the first output area counter 744*a* is "0". Because the two values are different with each other, the segment data input circuit 741 reads two sets of segment data whose top address is the obtained absolute address into the area CA2 corresponding to the value indicated by the first input area counter 743*a*. Then, the first input area counter 743*a* is incremented. Because the first input area counter 743*a* is a ternary counter circuit, the value indicated by the first input area counter 743*a* becomes "0". Furthermore, the relative address counter is incremented by 2. As a result, the value indicated by the relative address counter becomes "6".

The segment data request circuit 751 inputs the decoding number INCO and the processed data information OLDCNT from the tone pitch control circuit 730. Because the value of the decoding number INCO is "1", the decoding circuit 750 decodes a set of compressed data in the fifth period. First, the sample value output circuit 757 reads the sample values stored in the sample value buffers SB1 to SB3 into the delay memories DM1 to DM3. In the delay memory DM1, the delay memory DM2 and the delay memory DM3, as a result, the sample value D2, the sample value D1 and the sample value D0 are stored, respectively. Similarly to the above-described fourth period, by use of the processed data information OLDCNT supplied from the tone pitch control circuit 730, the segment data request circuit 751 supplies the counter update information UPD and the request data information REQ to the output area counter updating circuit 749, and also supplies the request data information REQ to the segment data output circuit 742. The counter update information UPD is "1", while the request data information REQ is "1". Therefore, the value indicated by the first output area counter 744*a* remains "0". At the calculation of the request data information REQ, the index number is "1". The segment data output circuit 742 supplies the segment data corresponding to the zeroth bit of the request data information REQ to the data retrieval circuit 753.

Because the index number is "1", the data retrieval circuit 753 retrieves compressed data $Z_3$ placed on the MSB side of the supplied segment data to supply the retrieved compressed data $Z_3$ to the shifting circuit 754. Similarly to the fourth period, the shifting circuit 754, the multiplier 755 and the adder 756 cooperate to figure out the sample value D3. The sample value output circuit 757 then stores the sample value D2, the sample value D1 and the sample value D0 stored in the delay memory DM1, the delay memory DM2 and the delay memory DM3 in the delay memory DM2, the delay memory DM3 and the delay memory DM4, respectively, and stores the sample value D3 in the delay memory DM1. The sample value output circuit 757 then supplies the sample values stored in the delay memories DM1 to DM4 to the interpolation circuit 760. The sample value output circuit 757 then stores the sample values stored in the delay memories DM1 to DM3 in the sample value buffers SB1 to SB3.

Similarly to the fourth period, the interpolation circuit 760 supplies the sample value D1 as the sample value W1 to the filter circuit 770. The filter circuit 770 and the tone volume control circuit 780 operate similarly to the case of the fourth period.

The tone pitch control circuit 730 supplies the decoding number INCO and the processed data information OLDCNT to the decoding circuit 750, and also supplies the interpolation coefficient calculation data FRAC to the interpolation circuit 760 to figure out the decoding number INCO and the interpolation coefficient calculation data FRAC for use in the sixth period. The decoding number INCO is "1", while the interpolation coefficient calculation data FRAC is "0". Because a set of compressed data has been decoded in the fifth period, the tone pitch control circuit 730 increments the index number which configures the processed data information OLDCNT by 1. By this increment, the index number becomes "1". The segment data number remains "1", with the frame number also remaining "0". The tone pitch control circuit 730 then stores the above-described decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 in the sixth period.

Next, the operation in the sixth period will be explained. Similarly to the second period, the segment data input circuit 741 will not read any segment data in the sixth period. Therefore, the value indicated by the first input area counter 743*a* remains "0".

The segment data request circuit 751 inputs the decoding number INCO and the processed data information OLDCNT from the tone pitch control circuit 730. Because the value of the decoding number INCO is "1", the decoding circuit 750 decodes a set of compressed data in the sixth period as well. First, the sample value output circuit 757 reads the sample values stored in the sample value buffers SB1 to SB3 into the delay memories DM1 to DM3. In the delay memory DM1, the delay memory DM2 and the delay memory DM3, as a result, the sample value D3, the sample value D2 and the sample value D1 are stored, respectively.

Similarly to the fifth period, by use of the processed data information OLDCNT supplied from the tone pitch control circuit 730, the segment data request circuit 751 supplies the counter update information UPD and the request data information REQ to the output area counter updating circuit 749, and also supplies the request data information REQ to the segment data output circuit 742. The counter update information UPD is "1", while the request data information REQ is "2". Therefore, the output area counter updating circuit 749 increments the first output area counter 744*a* by 1. By this increment, the value indicated by the first output area counter 744*a* becomes "1". The segment data output circuit 742 then supplies the value indicated by the first output area counter 744*a* and segment data placed in the area CA10 corresponding to the zeroth bit of the request data information REQ. At the calculation of the request data information REQ, the index number is "0". Therefore, the data retrieval circuit 753 retrieves compressed data $Z_4$ placed on the LSB side of the supplied segment data. The data retrieval circuit 753 also retrieves the parameter $P_2$ from the supplied segment data to write the retrieved parameter $P_2$ into the buffer memory. Similarly to the fifth period, the shifting circuit 754, the multiplier 755 and the adder 756 decode the sample value D4.

The sample value output circuit 757 stores the sample value D3, the sample value D2 and the sample value D1 stored in the delay memory DM1, the delay memory DM2 and the delay memory DM3 in the delay memory DM2, the delay memory DM3 and the delay memory DM4, respectively, and stores the sample value D4 in the delay memory DM1. The sample value output circuit 757 then supplies the sample values stored in the delay memories DM1 to DM4 to the interpolation circuit 760. The sample value output circuit 757 then stores the sample values stored in the delay memories DM1 to DM3 in the sample value buffers SB1 to SB3.

Similarly to the fifth period, the interpolation circuit 760 supplies the sample value D2 as the sample value W2 to the filter circuit 770. The filter circuit 770 and the tone volume control circuit 780 operate similarly to the fourth period.

The tone pitch control circuit 730 supplies the decoding number INCO and the processed data information OLDCNT to the decoding circuit 750, and supplies the interpolation coefficient calculation data FRAC to the interpolation circuit 760 to figure out the decoding number INCO and the interpolation coefficient calculation data FRAC for use in the seventh period. The decoding number INCO is "1", while the interpolation coefficient calculation data FRAC is "0". Because a set of compressed data has been decoded in the sixth period as well, the tone pitch control circuit 730 increments the index number which configures the processed data information OLDCNT by 1. By this increment, the index number becomes "0", with the segment data number becoming "2". However, the frame number remains "0". The tone pitch control circuit 730 stores the above-described decoding number INCO and processed data information OLDCNT, and the interpolation coefficient calculation data FRAC to supply the decoding number INCO and the processed data information OLDCNT to the decoding circuit 750 and to supply the interpolation coefficient calculation data FRAC to the interpolation circuit 760 in the seventh period.

The operation in the seventh and eighth periods which follow the sixth period is similar to that in the fifth and sixth periods. In the seventh period, more specifically, segment data is read into the area CA0, while sample value D5 is figured out by use of compressed data $Z_5$. In the eighth period, any segment data will not be read, for the eighth period is an even reproduction period. In the eighth period, furthermore, sample value D6 is figured out by use of compressed data $Z_6$. At the start of the following ninth period, both the values indicated by the first input area counter 743*a* and the first output area counter 744*a* are "1". In the ninth period, therefore, the segment data input circuit 741 will not read any segment data. Similarly to the fifth to eighth periods, the decoding circuit 750 figures out sample value D7 by use of compressed data $Z_7$. In the tenth period, the decoding circuit 750 figures out sample value D8 by use of compressed data $Z_8$, so that the value indicated by the first output area counter 744*a* is incremented. Because respective values indicated by the first input area counter 743*a* and the first output area counter 744*a* are different with each other at the start of the eleventh period, the segment data input circuit 741 reads segment data.

The explanation of the above-described first to sixth periods has been made, using the linear prediction coefficient C and the denormalization coefficient R written into the parameter memory 752 by the channel setting circuit 710. However, the linear prediction coefficient C and the denormalization coefficient R written into the parameter memory 752 by the channel setting circuit 710 are used only for decoding the frame data $FD_0$. For decoding the frame data $FD_1$ and later data, the linear prediction coefficient C and the denormalization coefficient R which have been retrieved to be stored in the parameter memory 752 by the data retrieval circuit 753 at the time of decoding of preceding frame data are used. In the above-described example, the decoding of the frame data $FD_0$ completes in the ninth period, so that the decoding of the frame data FD1 starts in the tenth period. At the end of the ninth period, by use of the parameters $P_0$ to $P_2$ stored in the buffer memory which is not shown, the data retrieval circuit 753 calculates the linear prediction coefficient C which is to be used for decoding the frame data $FD_1$ and writes the calculated linear prediction coefficient C into the parameter memory 752.

Furthermore, the data retrieval circuit 753 writes the parameter P3 stored in the buffer memory as the denormalization coefficient R which is to be used for decoding the frame data FD1 into the parameter memory 752.

Figure 14:
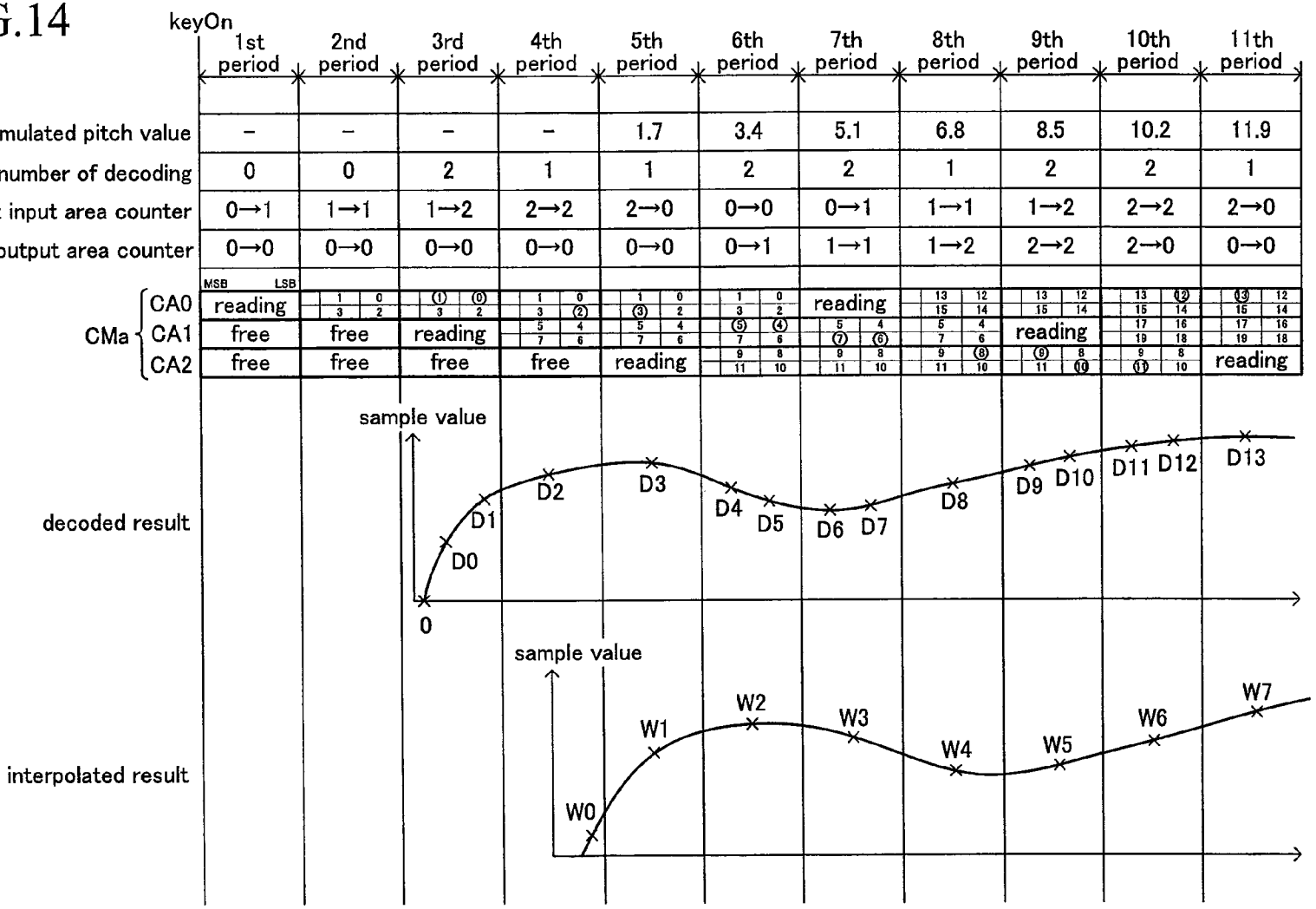
FIG. 14 is a time chart indicative of operation of the tone generator of a case in which the pitch magnification is "1.7"

Next, the operation of the tone generation channel CHa ("a" is an even number) which generates a musical tone in accordance with the waveform data indicated in FIG. 4 in a pitch which is 1.7 times greater than the original pitch in the first mode will be explained. The operation in the first to third periods is similar to that of the case of the above-described pitch magnification of "1.0". In addition, the operation of decoding the sample value D0 in the fourth period is also similar to the case of the pitch magnification of "1.0". In FIG. 14, similarly to FIG. 13, compressed data read into the cache memory CMa is indicated only by the numbers of the compressed data, while the numbers of compressed data used for decoding sample values in the respective reproduction periods are circled.

As for the operation of the tone pitch control circuit 730 in the fourth period, the calculation of the decoding number INCO and the interpolation coefficient calculation data FRAC for use in the fifth period will be explained. Similarly to the case of the pitch magnification of "1.0", in this example as well in which the pitch magnification is "1.7", the tone pitch control circuit 730 accumulates pitch magnification in each of the fourth and later periods to calculate the decoding number INCO and the interpolation coefficient calculation data FRAC in accordance with the accumulated pitch magnification. In the fourth period, the tone pitch control circuit 730 supplies the decoding number INCO and the processed data information OLDCNT to the decoding circuit 750, supplies the interpolation coefficient calculation data FRAC to the interpolation circuit 760, and then calculates the decoding number INCO and the interpolation coefficient calculation data FRAC for use in the fifth period. Therefore, the accumulated value of the pitch magnification in the fourth period is "1.7", with the increase in the integer being "1". More specifically, the value of the decoding number INCO of the fifth period is "1", while the value of the interpolation coefficient calculation data FRAC is "0.7". In FIG. 14 as well as FIG. 13, respective calculated results are listed on respective periods which follow the reproduction periods in which the tone pitch control circuit 730 has calculated the accumulated values of the pitch magnification.

Because a set of compressed data has been decoded in the fourth period, the tone pitch control circuit 730 increments the index number which configures the processed data information OLDCNT. By this increment, the index number becomes "0", while the segment data number becomes "1". However, the frame data number remains "0". The tone pitch control circuit 730 stores the above-described decoding number INCO and processed data information OLDCNT and the interpolation coefficient calculation data FRAC to supply the decoding number INCO and the processed data information OLDCNT to the decoding circuit 750 and to supply the interpolation calculation data FRAC to the interpolation circuit 760 in the fifth period.

Next, the operation in the fifth period will be explained. The segment data input circuit 741 operates similarly to the case of the pitch magnification of "1.0".

Similarly to the case of the pitch magnification of "1.0", the decoding circuit 750 calculates the sample value D3 by use of the compressed data $Z_3$. The sample value output circuit 757 supplies the sample values D3 to D0 to the interpolation circuit 760. The interpolation circuit 760 inputs the interpolation coefficient calculation data FRAC from the tone pitch control circuit 730. As described above, the value of this interpolation coefficient calculation data FRAC is "0.7". The interpolation circuit 760 performs interpolation by use of the sample values D3 to D0 and the interpolation coefficient calculation data FRAC to calculate the sample value W1 corresponding to the pitch accumulated value (=1.7). The interpolation circuit 760 then supplies the calculated sample value W1 to the filter circuit 770. The filter circuit 770 operates similarly to the case of the pitch magnification of "1.0".

The tone pitch control circuit 730 supplies the decoding number INCO and the processed data information OLDCNT to the decoding circuit 750, supplies the interpolation coefficient calculation data FRAC to the interpolation circuit 760, and then calculates the decoding number INCO and the interpolation coefficient calculation data FRAC for use in the sixth period. Because the accumulated value of the pitch magnification is "3.4", the decoding number INCO is "2", with the interpolation coefficient calculation data FRAC being "0.4". Because a set of sample value has been decoded in the fifth period, the tone pitch control circuit 730 increments the index number which configures the processed data information OLDCNT by 1. By this increment, the index number becomes "1". The segment data number is "1", while the frame number is "0". The tone pitch control circuit 730 stores the above-described decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 in the sixth period.

Next, the operation of the sixth period will be explained. Similarly to the case of the pitch magnification of "1.0", the segment data input circuit 741 will not read any segment data. The segment data request circuit 751 inputs the decoding number INCO and the processed data information OLDCNT from the tone pitch control circuit 730. Because the value of the decoding number INCO is "2", the decoding circuit 750 decodes two sets of compressed data in the sixth period. More specifically, the decoding circuit 750 calculates the sample value D4 and the sample value D5. The calculation of the sample value D4 and the sample value D5 is done similarly to the case of the pitch magnification of "1.0". By use of the processed data information OLDCNT supplied from the tone pitch control circuit 730, more specifically, the segment data request circuit 751 supplies the counter update information UPD and the request data information REQ to the output area counter updating circuit 749, and also supplies the request data information REQ to the segment data output circuit 742. The decoding circuit 750 then retrieves compressed data corresponding to the index number from the segment data supplied from the segment data output circuit 742 to calculate a sample value by use of the retrieved compressed data. At the calculation of the first sample value (that is, the sample value D4), the value indicated by the first output area counter 744*b* becomes "1", while at the calculation of the second sample value (that is, the sample value D5), the value indicated by the first output area counter 744*b* will not be updated, but remains "1". The sample values D5 to D2 are then supplied to the interpolation circuit 760. The interpolation circuit 760 inputs the interpolation coefficient calculation data FRAC from the tone pitch control circuit 730. As described above, the value of this interpolation coefficient calculation data FRAC is "0.4". The interpolation circuit 760 performs interpolation by use of the sample values D5 to D2 and the interpolation coefficient calculation data FRAC to figure out the sample value W2 corresponding to the accumulated value (=3.4) of the pitch magnification. The interpolation circuit 760 then supplies the sample value W2 to the filter circuit 770. The filter circuit 770 and circuits following the filter circuit 770 operate similarly to the case of the above-described pitch magnification, "1.0".

The tone pitch control circuit 730 also supplies the decoding number INCO and the processed data information OLDCNT to the decoding circuit 750, supplies the interpolation coefficient calculation data FRAC to the interpolation circuit 760, and then calculates the decoding number INCO and the interpolation coefficient calculation data FRAC for use in the seventh period. Because the two sets of compressed data have been decoded in the sixth period, the tone pitch control circuit 730 increments the index number which configures the processed data information OLDCNT by 2. By this increment, the index number becomes "1", while the segment number becomes "2". The frame number remains "0". The tone pitch control circuit 730 stores the above-described decoding number INCO and processed data information OLDCNT, and the interpolation coefficient calculation data FRAC to supply the decoding number INCO and the processed data information OLDCNT to the decoding circuit 750 and to supply the interpolation coefficient calculation data FRAC to the interpolation circuit 760 in the seventh period.

The operation in the sixth and later periods is similar to that in the above-described fifth or sixth period. More specifically, the accumulated values of the pitch magnification in the seventh and later periods are "5.1", "6.8", "8.5", "10.2", "11.9", . . . , respectively, with the decoding numbers INCO being "2", "1", "2", "2", "1" . . . , respectively. In the respective periods, furthermore, if the cache memory CMa has free space, segment data is read from the waveform memory WM, so that the first input area counter 743*a* will be incremented. In accordance with the calculated decoding number INCO, furthermore, one or two sets of compressed data are decoded, whereas the value indicated by the first output area counter 744*b* is incremented each time the area (CA0 to CA1) where compressed data which is to be decoded is stored switches. In the seventh period, for example, segment data is read into the area CA0, whereas the compressed data $Z_6$ and the compressed data $Z_7$ are used to calculate the sample value D6 and the sample value D7, respectively. As a result, although the. value indicated by the first input area counter 743*a* becomes "1", the value indicated by the first output area counter 744*b* remains "1". In the eighth period, for example, because the eighth period is an even reproduction period, any segment data will not be read. Therefore, the value indicated by the first input area counter 743*a* remains "1". In the eighth period, furthermore, a set of compressed data $Z_8$ is used to figure out the sample value D8. As a result, the value indicated by the first output area counter 744*b* becomes "2".

In the above-described case of the pitch magnification of "1.0", because the value indicated by the first input area counter 743*a* is identical with the value indicated by the first output area counter 744*a* at the start of the ninth period, the segment data input circuit 741 will not read any segment data into the cache memory CMa in the ninth period. However, the decoding numbers of the sixth and seventh periods of the case in which the pitch magnification is "1.7" are more than the decoding numbers of the sixth and seventh periods of the case in which the pitch magnification is "1.0". In the case where the pitch magnification is "1.7", therefore, the values indicated by the first output area counter 744*a* proceed faster than the case where the pitch magnification is "1.0". At the start of the ninth period, as a result, the values indicated by the first input area counter 743*a* and the first output area counter 744*a* are different with each other. Therefore, the segment data input circuit 741 reads segment data into the cache memory CMa in the ninth period as well. The operation in the tenth and later periods is also similar to the above-described operation in the fifth to ninth periods. In the case where the pitch magnification is "1.7", the decoding of the frame data $FD_0$ completes in the seventh period, so that the decoding of the frame data Fai starts in the eighth period. For the decoding of the frame data $FD_1$ in the eighth and later periods, therefore, the linear prediction coefficient C and the denormalization coefficient R stored in the parameter memory 752 are used for decoding the frame data $FD_1$.

Figure 15:
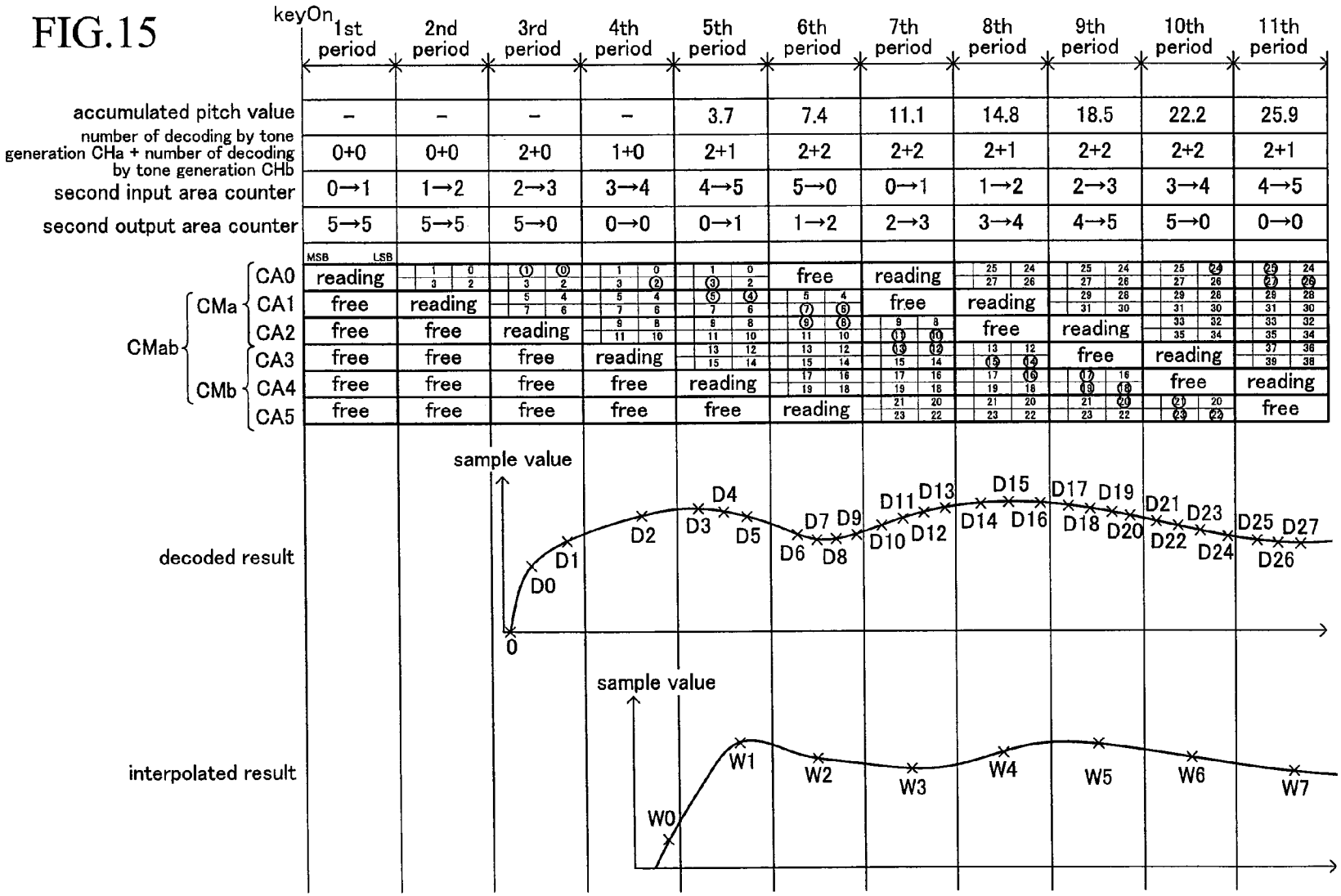
FIG. 15 is a time chart indicative of operation of the tone generator of a case in which the pitch magnification is "3.7".

Next, the operation of the tone generation channel CHa and the tone generation channel CHb which generate a musical tone in accordance with the waveform data indicated in FIG. 4 in a pitch which is 3.7 times greater than the original pitch in the second mode will be explained with reference to FIG. 15. However, "a" is an even number, and "b" is a value obtained by adding "1" to "a". In this case, the cache memory CMa of the tone generation channel CHa and the cache memory CMb of the tone generation channel CHb are used integrally as a cache memory CMab which is separated into areas CA0 to CA5 each having a storage area for storing two words. For processing for the tone generation channel CHb, parameters for the tone generation channel CHa are used. For processing for the tone generation channel CHb, more specifically, the value indicated by the relative address counter, the value indicated by the input area counter memory 745, the value indicated by the output area counter memory 746, the processed data information OLDCNT, the format data BPS, the linear prediction coefficient C, the denormalization coefficient R and sample values written into the sample value buffers SB1 to SB3 stored in order to be used for the tone generation channel CHa are used. However, the decoding number INCO is calculated for the tone generation channel CHa and the tone generation channel CHb, respectively.

First, the operation of the tone generation channel CHa in the first period will be explained. The input area counter updating circuit 748 resets the value indicated by the second input area counter 743*b* to "0". The output area counter updating circuit 749 resets the value indicated by the second output area counter 744*b* to "5". The tone pitch control circuit 730 resets the frame data number to "n", the segment data number to "3", and the index number to "1", respectively. The tone pitch control circuit 730 initializes the processed data information OLDCNT at the time of the start of the first period. More specifically, the tone pitch control circuit 730 sets the frame data number at "n", the segment data number at "3", and the index data number at "1". The segment data input circuit 741 uses the second input area counter 743*b* and the second output area counter 744*b* instead of the first input area counter 743*a* and the first output area counter 744*a* used in the first mode, but operates similarly to the first period of the case in which the pitch magnification is "1.0". More specifically, the segment data input circuit 741 reads the top two sets of segment data from the waveform memory WM into the area CA0. As a result, the value indicated by the second input area counter 743*b* becomes "1". The decoding circuit 750 and circuits following the decoding circuit 750 will not operate, Because any compressed data will not be decoded in the first period, the tone pitch control circuit 730 will not update the processed data information OLDCNT. In FIG. 15, similarly to FIG. 13, compressed data read into the cache memory CMab is indicated only by the numbers of the compressed data, while the numbers of compressed data which are to be decoded in the respective reproduction periods are circled.

Next, the operation of the tone generation channel CHb in the first period will be explained. Because the tone generation channel CHb is a tone generation channel having an odd number, the segment data input circuit 741 will not read any segment data in the first period even if the cache memory CMab has free space. At the start of the processing of the tone generation channel CHb in the first period, the segment data request circuit 751 inputs the decoding number INCO of the first period from the channel setting circuit 710. However, because the value of the decoding number INCO is "0", the decoding circuit 750 and the circuits following the decoding circuit 750 will not operate. The tone pitch control circuit 730 inputs the decoding number INCO and the interpolation coefficient calculation data FRAC of the second period from the channel setting circuit 710. The value of this decoding number INCO is "0", whereas the value of the interpolation coefficient calculation data FRAC is "0". Because any compressed data has not been decoded in the first period as described above, the tone pitch control circuit 730 will not update the processed data information OLDCNT. The tone pitch control circuit 730 stores the above-described decoding number INCO and processed data information OLDCNT, and the interpolation coefficient calculation data FRAC to supply the decoding number INCO and processed data information OLDCNT to the decoding circuit 750 and to supply the interpolation coefficient calculation data FRAC to the interpolation circuit 760 at the time of processing in the tone generation channel CHb in the second period.

Next, the operation of the tone generation channel CHa in the second period will be explained. The generation of the tone generation channel CHa in the second period is similar to that in the first mode. More specifically, the tone pitch control circuit 730 inputs the decoding number INCO and the interpolation coefficient calculation data FRAC of the third period from the channel setting circuit 710 and stores the input decoding number INCO and interpolation coefficient calculation data FRAC, but the other circuits will not operate. The value of this decoding number INCO is "2", whereas the value of the interpolation coefficient calculation data FRAC is "0".

Next, the operation of the tone generation channel CHb in the second period will be explained. By use of the value of the relative address counter and the value of the top address, the segment data input circuit 741 calculates the absolute address of the segment data which is to be input. Because the value indicated by the second input area counter 743*b* is "1" with the value of the second output area counter 744*b* being "5", the second comparing device 747*b* supplies a signal indicating that the cache memory CMab has free space to the segment data input circuit 741. Therefore, the segment data input circuit 741 inputs two sets of segment data whose top address is the above-calculated address to the area CA1 corresponding to the value indicated by the second input area counter 743*b*. The input area counter updating circuit 748 then increments the second input area counter 743*b* by 1. By this increment, the value indicated by the second input area counter 743*b* becomes "2". The segment data input circuit 741 increments the relative address counter by 2. By this increment, the value indicated by the relative address counter becomes "4".

At the time of the start of the processing in the tone generation channel CHb in the second period, the segment data request circuit 751 inputs the decoding number INCO of the second period from the tone pitch control circuit 730. However, because the value of the decoding number INCO is "0", the decoding circuit 750 and the circuits which follow the decoding circuit 750 will not operate. The tone pitch control circuit 730 supplies the decoding number INCO and the processed data information OLDCNT to the decoding circuit 750, supplies the interpolation coefficient calculation data FRAC to the interpolation circuit 760, and then inputs the decoding number INCO and the interpolation coefficient calculation data FRAC of the third period from the channel setting circuit 710. The value of this decoding number INCO is "2". In the second mode, however, the decoding number INCO input from the channel setting circuit 710 indicates the total number of the sample values which are to be decoded in the tone generation channel CHa and the tone generation channel CHb. Because the value of the decoding number INCO of the tone generation channel CHa of the third period is "2" as described above, the decoding number INCO of the tone generation channel CHb is "0". The value of the interpolation coefficient calculation data is "0". Because any compressed data has not been decoded in the second period as described above, the tone pitch control circuit 730 will not update the processed data information OLDCNT. The tone pitch control circuit 730 stores the above-described decoding number INCO, processed data information OLDCNT and interpolation coefficient calculation data FRAC to supply to the decoding circuit 750 and the interpolation circuit 760 at the time of processing in the tone generation channel CHb in the third period.

Next, the operation of the tone generation channel CHa in the third period will be explained. Similarly to the first period, the segment data input circuit 741 inputs two sets of segment data to the area CA2. As a result, the value indicated by the second input area counter 743*b* becomes "3", whereas the value indicated by the relative address counter becomes "6".

Similarly to the third period of the above-described case in which the pitch magnification is "1.0", the decoding circuit 750 calculates two sample values D0 and D1. As a result, the value indicated by the second output area counter 744*b* becomes "0". The sample value D1, the sample value D0 and the initial sample value Di are stored in the sample value buffer SB1, the sample value buffer SB2 and the sample value buffer SB3, respectively. As for the tone generation channel CHa in the second mode, because sample values will not be supplied to the interpolation circuit 760, the interpolation circuit 760, the filter circuit 770 and the tone volume control circuit 780 will not operate.

The tone pitch control circuit 730 supplies the decoding number INCO and the processed data information OLDCNT to the decoding circuit 750, supplies the interpolation coefficient calculation data FRAC to the interpolation circuit 760, and then inputs the decoding number INCO and the interpolation coefficient calculation data FRAC for use in the fourth period from the channel setting circuit 710. The value of this decoding number INCO is "1". Because the two sets of compressed data have been decoded in the third period, the tone pitch control circuit 730 increments the index number which configures the processed data information OLDCNT by 2. By this increment, the index number becomes "1". The segment data number and the frame data number remain "0", respectively. The tone pitch control circuit 730 stores the above-described decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 at the processing of the tone generation channel CHa in the fourth period.

Next, the operation of the tone generation channel CHb in the third period will be explained. Because the tone generation channel CHb is a tone generation channel of an odd number, the segment data input circuit 741 will not read any segment data. The sample value output circuit 757 reads the sample values stored in the sample value buffers SB1 to SB3 into the delay memories DM1 to DM3. The segment data request circuit 751 inputs the decoding number INCO and the processed data information OLDCNT from the tone pitch control circuit 730. However, because the decoding number INCO is "0", the decoding circuit 750 will not decode any compressed data. The value indicated by the second output area counter 744*b* will not be updated, but remains "0". Because the number of sample values calculated by the third and earlier periods is two, the sample value output circuit 757 will not supply the sample values to the interpolation circuit 760. As a result, the interpolation circuit 760, the filter circuit 770 and the tone volume control circuit 780 will not operate.

The tone pitch control circuit 730 supplies the decoding number INCO and the processed data information OLDCNT to the decoding circuit 750, supplies the interpolation coefficient calculation data FRAC to the interpolation circuit 760; and then inputs the decoding number INCO and the interpolation coefficient calculation data FRAC for use in the fourth period from the channel setting circuit 710. Although the value of this decoding number is "1", the value of the decoding number INCO is the sum of the respective decoding numbers INCO of the tone generation channel CHa and the tone generation channel CHb in the fourth period. Because the decoding number INCO processed by the tone generation channel CHa in the fourth period is "1" as described above, the decoding number INCO of the tone generation channel CHb is "0". Furthermore, the value of the interpolation coefficient calculation data FRAC is "0". Because any compressed data has not been decoded in the tone generation channel CHb in the third period as described above, the tone pitch control circuit 730 will not update the processed data information OLDCNT. The tone pitch control circuit 730 stores the above-described decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 at the processing of the tone generation channel CHb in the fourth period.

Next, the operation of the tone generation channel CHa in the fourth period will be explained. Because the tone generation channel CHa is a tone generation channel of an even number, the segment data input circuit 741 will not read any segment data in the fourth period. The decoding circuit 750 operates similarly to the case of the fourth period of the pitch magnification of "1.0". More specifically, the decoding circuit 750 calculates the sample value D2. The value indicated by the second output area counter 744*b* remains "0". In this case as well, the sample value output circuit 757 will not supply any sample values to the interpolation circuit 760. As a result, the interpolation circuit 760 and the circuits following the interpolation circuit 760 will not operate. The sample value output circuit 757 stores the sample values D2 to D0 in the sample value buffers SB1 to SB3.

Similarly to the cases in which the pitch magnification is "1.0" and "1.7", the tone pitch control circuit 730 accumulates pitch magnification in each of the fourth and later periods to calculate the decoding number INCO in accordance with the accumulated pitch magnification. The tone pitch control circuit 730 supplies the decoding number INCO and the processed data information OLDCNT to the decoding circuit 750, supplies the interpolation coefficient calculation data FRAC to the interpolation circuit 760, and then calculates the decoding number INCO and the interpolation coefficient calculation data FRAC for use in the fifth period. Because the pitch magnification of this example is "3.7", the accumulated value of the pitch magnification in the fourth period is "3.7", with the increase in the integer being "3". That is, three sample values are to be decoded in the fifth period. More specifically, two sample values are to be decoded in the processing in the tone generation channel CHa, whereas the remaining one sample value is to be decoded in the processing in the tone generation channel CHb. Therefore, the decoding number INCO of the tone generation channel CHa in the fifth period is "2". Furthermore, the value of the interpolation coefficient calculation data FRAC is "0.7". In FIG. 15 as well as FIG. 13 and FIG. 14, respective calculated results are listed on respective periods which follow the reproduction periods in which the tone pitch control circuit 730 has calculated the accumulated values of the pitch magnification.

Because the one set of compressed data has been decoded in the fourth period, the tone pitch control circuit 730 increments the index number which configures the processed data information OLDCNT by 1. By this increment, the index number becomes "0", while the segment number becomes "1". The frame data number remains "0". The tone pitch control circuit 730 stores the above-described decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 in the processing of the tone generation channel CHa in the fifth period.

Next, the operation of the tone generation channel CHb in the fourth period will be explained. Similarly to the second period, the segment data input circuit 741 inputs two sets of segment data to the area CA3. As a result, the second input area counter 743*b* indicates "4", whereas the relative address counter indicates "8". The sample value output circuit 757 reads the sample values stored in the sample value buffers SB1 to SB3 into the delay memories DM1 to DM3. The segment data request circuit 751 inputs the decoding number INCO and the processed data information OLDCNT from the tone pitch control circuit 730. However, because the decoding number INCO is "0", the decoding circuit 750 will not decode any sample values. The value indicated by the second output area counter 744*b* will not be updated, but remains "0". The sample value output circuit 757 supplies the sample values (that is, the sample values D2 to D0 and the initial sample value Di) stored in the delay memories DM1 to DM4 to the interpolation circuit 760. The sample value output circuit 757 then stores the sample values (that is, the sample values D2 to D0) stored in the delay memories DM1 to DM3 in the sample value buffers SB1 to SB3.

The interpolation circuit 760 inputs the interpolation coefficient calculation data FRAC from the tone pitch control circuit 730. Because the interpolation coefficient calculation data FRAC is "0", the interpolation circuit 760 supplies the sample value D0 as the initial sample value W0 to the filter circuit 770. The filter circuit 770 and the circuits following the filter circuit 770 operate similarly to the case of the first mode.

Furthermore, the tone pitch control circuit 730 calculates the decoding number INCO and the interpolation coefficient calculation data FRAC for use in the tone generation channel CHb in the fifth period. As described in the explanation of the operation of the tone generation channel CHa in the fourth period, the value of the decoding number INCO of the tone generation channel CHb in the fifth period is "1". The value of the interpolation coefficient calculation data FRAC is "0.7". Because any compressed data will not be decoded in the tone generation channel CHb in the fourth period as described above, the tone pitch control circuit 730 will not update the processed data information OLDCNT.

Next, the operation of the tone generation channel CHa in the fifth period will be explained. Similarly to the first period, the segment data input circuit 741 reads two sets of segment data into the area CA4. As a result, the second input area counter 743*b* indicates "5", while the relative address counter indicates "10".

The sample value output circuit 757 reads the sample values stored in the sample value buffers SB1 to SB3 into the delay memories DM1 to DM3. The segment data request circuit 751 inputs the decoding number INCO and the processed data information OLDCNT of the fifth period from the tone pitch control circuit 730. Because the value of the decoding number INCO is "2", the decoding circuit 750 is to decode two sets of compressed data. Similarly to the third period, more specifically, the decoding circuit 750 calculates two sample values D3 and D4. As a result, the second output area counter 744*b* indicates "1". In this case as well, the sample value output circuit 757 will not supply any sample values to the interpolation circuit 760. Therefore, the interpolation circuit 760 and the circuits following the interpolation circuit 760 will not operate. The sample value output circuit 757 stores the sample values D4 to D2 in the sample value buffers SB1 to SB3.

Similarly to the fourth period, the tone pitch control circuit 730 accumulates pitch magnification to calculate the decoding number INCO and the interpolation coefficient calculation data FRAC for use in the sixth period. The accumulated value of the pitch magnification is "7.4". Therefore, the increase in the integer of the accumulated value of the pitch magnification is "4". Resultantly, four sets of compressed data are to be decoded by use of the tone generation channel CHa and the tone generation channel CHb in the sixth period. By the tone generation channel CHa, in this case, two sets of compressed data are to be decoded, whereas the remaining two sets of compressed data are to be decoded by the tone generation channel CHb. More specifically, the decoding number INCO of the tone generation channel CHa in the sixth period is "2". Because the two sets of compressed data have been decoded in the fifth period, the tone pitch control circuit 730 adds "2" to the index number which configures the processed data information OLDCNT. As a result, the index number becomes "0", whereas the segment number becomes "2". The frame number is "0". The tone pitch control circuit 730 stores the decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 in the processing of the tone generation channel CHa in the sixth period.

Next, the operation of the tone generation channel CHb in the fifth period will be explained. Because the tone generation channel CHb is a tone generation channel of an odd number, the input circuit will not read any segment data in the fifth period. The sample value output circuit 757 reads the sample values stored in the sample value buffers SB1 to SB3 into the delay memories DM1 to DM3. The segment data request circuit 751 inputs the decoding number INCO and the processed data information OLDCNT from the tone pitch control circuit 730. Because the value of the decoding number INCO is "1", the decoding circuit 750 decodes a set of compressed data. More specifically, the decoding circuit 750 calculates one sample value D5. The value indicated by the second output area counter 744*b* remains "1". The sample value output circuit 757 supplies the sample values (that is, the sample values D5 to D2) stored in the delay memories DM1 to DM4 to the interpolation circuit 760. The sample value output circuit 757 then stores the sample values (that is, the sample values D5 to D3) stored in the delay memories DM1 to DM3 in the sample value buffers SB1 to SB3.

The interpolation circuit 760 inputs the interpolation coefficient calculation data FRAC from the tone pitch control circuit 730. As described above, the value of the interpolation coefficient calculation data FRAC is "0.7". The interpolation circuit 760 performs interpolation by use of the sample values D5 to D2 and the interpolation coefficient calculation data FRAC to figure out the sample value W1 corresponding to the accumulated pitch value (=3.7). The interpolation circuit 760 then supplies the sample value IN1 to the filter circuit 770. The filter circuit 770 and the circuits following the filter circuit 770 operate similarly to the case in which the pitch magnification is "1.0". The filter circuit 770 and the circuits following the filter circuit 770 operate similarly to the case of the first mode.

The tone pitch control circuit 730 calculates the decoding number INCO of the tone generation channel CHb for use in the sixth period. As explained in the operation of the tone generation channel CHa in the fifth period, the value of the decoding number INCO of the tone generation channel CHb is "2". In addition, because the accumulated value of the pitch magnification is "7.4", the value of the interpolation coefficient calculation data FRAC is "0.4". Furthermore, because a set of compressed data has been decoded in the fifth period as described above, the index number which configures the processed data information OLDCNT is incremented by 1. By this increment, the index number becomes "1". The segment number is "2", whereas the frame number is "0". The tone pitch control circuit 730 stores the above-described decoding number INCO and processed data information OLDCNT and the interpolation coefficient calculation data FRAC to supply the decoding number INCO and the processed data information OLDCNT to the decoding circuit 750 and to supply the interpolation coefficient calculation data FRAC to the interpolation circuit 760 at the processing of the tone generation channel CHb in the sixth period.

The operation in the sixth and later periods is similar to that in the fifth period. More specifically, the accumulated values of the pitch magnification in the sixth and later periods are "7.4", "11.1", "14.8", "18.5", "22.2", "25.9", . . . . The decoding number INCO of the tone generation channel CHa in the respective periods is "2", whereas the decoding numbers INCO of the tone generation channel CHb are "2", "2", "1", "2", "2", "1", . . . . In the fifth period, the tone generation channel CHb has decoded a set of compressed data. In some periods such as the sixth, seventh, tenth and eleventh periods, however, two sets of compressed data are decoded in the tone generation channel CHb as well. In this example, furthermore, there is no reproduction period in which the values indicated by the second input area counter 743*b* and the second output area counter 744*b* are identical with each other, so that the input circuit will not read any segment data. Similarly to the first mode, furthermore, as for the decoding of the top frame data $FD_0$, the linear prediction coefficient C written into the real-time control register 712 is to be used. As for the decoding of the frame data $FD_1$ and the later data, however, linear prediction coefficients obtained in decoding of the respective immediately preceding frame data are used.

The musical tone signal generating apparatus configured as described above calculates a sample value by use of two tone generation channels in the case where waveform data having a possibility that the pitch magnification may be "2.0" or more has been selected. In the present embodiment, although sets of compressed data have to be decoded sequentially from the top, up to four sets of compressed data can be decoded in each reproduction period by use of the two tone generation channels as described above. Therefore, the pitch magnification can be set at up to "4.0". In this case, the capacity of the waveform memory can be reduced, for musical tones can be sampled every two octaves. In a case where the waveform data which does not require the pitch magnification of "2.0" or more is selected, the musical tone signal generating apparatus calculates a sample value by use of one tone generation channel. Therefore, the musical tone signal generating apparatus will not significantly reduce the number of musical tone signals which are to be generated concurrently. As the waveform memory WM, furthermore, the musical tone signal generating apparatus adopts the page-accessible memory. If a period obtained by dividing a reproduction period into 256 sections which is the total number of tone generation channels is defined as a cache processing period in which segment data for each tone generation channel is read out, the processing period is so short that even a set of segment data cannot be read out. In this embodiment, therefore, a period obtained by dividing a sampling period into 128 sections is defined as a cache processing period so that each tone generation channel will read segment data every two sampling periods. This cache processing period is long enough to read two sets of segment data by page-reading. In addition, because a set of segment data includes two sets of compressed data, compressed data necessary for a tone generation channel to calculate sample values in the two reproduction periods can be previously read.

In carrying out the present invention, the present invention is not limited to the above-described embodiment but can be variously modified without departing from the object of the invention.

In the second mode of the above-describe embodiment, by using the tone generation channel CHa and the tone generation channel CHb, the musical tone signal generating apparatus is able to have the pitch magnification of up to "4.0". By using more tone generation channels, however, the value of the pitch magnification can be increased further. By using three tone generation channels, for example, the value of the pitch magnification can be increased up to "6.0".

In the above-described embodiment, furthermore, a predicted value is figured out by use of the latest sample value WD1 of the sample values that have been already decoded. However, the musical tone signal generating apparatus may figure out a predicted value by use of the sample value WD2, the sample value WD3 or the sample value WD4 which have been decoded before the decoding of the sample value WD1. In this case, the musical tone signal generating apparatus is designed to store, in the frame data, a linear prediction coefficient which is to be multiplied by the respective sample values so that the data retrieval circuit 753 will retrieves the linear prediction coefficient from the frame data.

In the above-described embodiment, furthermore, the low-order twelve bits of segment data are separated into two equal parts. However, the low-order twelve bits may be separated into any number of equal parts, such as three equal parts, four equal parts and six equal parts. However, every set of segment data is to be separated similarly. An increase in the number of equal parts into which the low-order twelve bits are separated increases the number of compressed data sets which can be stored in a set of segment data, but decreases the largest value of a set of compressed data. In a case where the low-order twelve bits of segment data are separated into three equal parts, for example, the data length of each set of compressed data is four bits. Assume that the highest order bit whose value of the largest residual data in a selected frame is "1" in binary notation is the x-th bit (x=4, 5, . . . , 16). In this case, the four bits ranging from the (x−3)th bit to the x-th bit are a set of compressed data. In a case where a set of segment data is separated into four equal parts, three bits ranging from the (x−2)th bit to the x-th bit of the residual data are a set of compressed data. In a case where a set of segment data is separated into six equal parts, two bits ranging from the (x−1)th bit to the x-th bit are a set of compressed data. In the above-described embodiment furthermore, a frame includes compressed data corresponding to sample values for eight periods. In a case where the number of segment data sets which configure a set of frame data is four as in the case of the above-described embodiment, as the number of parts into which a set of segment data is separated increases, a frame includes compressed data corresponding to sample values of more periods. However, because the number of segment data sets configuring a set of frame data is not limited to four, the number of segment data sets configuring a set of frame data can be increased or decreased, according to the number of parts into which a segment data set is separated, to adjust the number of compressed data sets included in a frame.

In the above-described embodiment, furthermore, every segment data set includes two sets of compressed data. However, the number of compressed data sets included in a set of segment data may vary according to frame. In this case, the format data BPS is to be updated for each frame. More specifically, format data BPS is stored as voice data for each frame so that at each switching of frames, corresponding format data BPS will be supplied from the channel setting circuit 710 to the tone pitch control circuit 730 and the decoding circuit 750. In this case, furthermore, similarly to the linear prediction coefficient C and the denormalization coefficient R, a set of segment data may include format data BPS so that the format data BPS will be retrieved from the segment data set by the data retrieval circuit 753 to be stored in the parameter memory 752 and to be supplied to the tone pitch control circuit 730. By such a configuration, a frame having residual data whose value is great due to wide variations in sample values can increase the data length of compressed data, whereas a frame having residual data whose value is small due to narrow variations in sample values can reduce the data length of compressed data. As described above, waveform data can be compressed efficiently to reduce the storage space of the waveform memory WM.

In the above-described embodiment, sample values are compressed by linear prediction, whereas the immediately preceding sample value is used to figure out the next sample value. However, any method of figuring out the next sample value can be applied to the present invention as long as the method uses one or more sample values which have been already figured out.

In the above-described embodiment, furthermore, for the sake of simplifying the explanation, the generation of a musical tone terminates after the decoding of the last frame completes. After the completion of the decoding of the last frame, however, the decoding circuit 750 may return to the top frame or any one of the frames to sequentially decode that frame and the following frames again. That is, the musical tone signal generating apparatus may be capable of loop-reproduction. In this case, at the time of the first decoding of the top frame of the loop, the linear prediction coefficient C and the denormalization coefficient R used for the decoding of the frame is stored so that at the start of the reproduction of the loop which follows the completion of the decoding of the top to the last frames of waveform data, the stored linear prediction coefficient C and the denormalization coefficient R will be written into the parameter memory 752. In this case, furthermore, the decoding circuit 750 stores the last four sample values decoded at the time of the decoding of a frame which immediately precedes the top frame of the loop. When the decoding circuit 750 starts the loop-reproduction, the stored last four sample values are written into the delay memories DM1 to DM4. By such a configuration, the musical tone signal generating apparatus can repeatedly reproduce a section having small variations in waveform, successfully reducing the capacity of the waveform memory WM.

What is claimed is:

1. A musical tone signal generating apparatus comprising:

a waveform memory in which waveform data formed of a plurality of compressed data sets obtained by sampling a plurality of musical tones having different tone pitches and compressing sample values in relation to differences between the sample values and their respective immediately preceding sample values is stored for the respective tone pitches;

computing circuitry for reading compressed data from the waveform memory within an assigned computing period of time in response to instructions to generate a musical tone, decoding the compressed data, and outputting data indicative of a sample value of the decoded compressed data;

computing period determining processing unit for inputting tone pitch information indicative of a tone pitch of the musical tone which is to be generated, identifying waveform data which is among the plurality of waveform data stored in the waveform memory and is to be read by the computing circuitry, and determining the length of the assigned computing period of time in accordance with the identified waveform data; and interpolating circuitry for interpolating the data indicative of the sample value output by the computing circuitry in accordance with a ratio of the tone pitch of the musical tone which is to be generated to an original tone pitch of a musical tone represented by the waveform data identified by the computing period determining processing unit, and outputting the interpolated result.

2. The musical tone signal generating apparatus according to claim 1, wherein the compressed data is calculated in accordance with a difference between a sample value and a sample value predicted by use of linear prediction.

3. The musical tone signal generating apparatus according to claim 1, further comprising:

decoding number calculating circuitry for calculating, in accordance with the ratio of the tone pitch of the musical tone which is to be generated to the original tone pitch of the musical tone represented by the waveform data identified by the computing period determining processing unit, the number of compressed data sets which are to be decoded in the computing period.

4. The musical tone signal generating apparatus according to claim 1, wherein the computing circuitry includes:

cache circuitry for performing cache processing for reading the compressed data from the waveform memory and temporarily storing the read compressed data; and decoding circuitry for performing decoding processing for decoding the compressed data stored in the cache circuitry and calculating a sample value; and the computing period is formed of:

a cache processing period in which the cache circuitry performs the caching processing; and a decoding period in which the decoding circuitry performs the decoding processing.

5. The musical tone signal generating apparatus according to claim 4, wherein the waveform memory is a memory which is separated into pages each having a certain address range, and is configured such that when reading of a first data stored in an address is continuously followed by reading of a second data from a page in which the first data is also stored, the second data can be read faster than the first data; and the cache processing period is longer than a period of time necessary to read at least two sets of data from a page.

6. The musical tone signal generating apparatus according to claim 5, wherein the first data and the second data include the compressed data sets, respectively.

7. The musical tone signal generating apparatus according to claim 4, wherein each of the cache processing period and the decoding processing period is formed of one or more of time-division time slots obtained by time-dividing a certain period of time; and the computing period determining processing unit determines, in accordance with the identified waveform data, the respective numbers of time-division time slots assigned as the cache processing period and the decoding processing period, respectively.

* * * * *